US011193714B2

(12) United States Patent
Russell et al.

(10) Patent No.: US 11,193,714 B2
(45) Date of Patent: Dec. 7, 2021

(54) RETENTION MECHANISM FOR REFRACTORY INSERTS FOR REFORMER FLUE GAS TUNNEL

(71) Applicant: BLASCH PRECISION CERAMICS, INC., Albany, NY (US)

(72) Inventors: William P. Russell, Watervliet, NY (US); Jeffrey J. Bolebruch, Amsterdam, NY (US); Joseph D. Quintiliani, Troy, NY (US)

(73) Assignee: Blasch Precision Ceramics, Inc., Albany, NY (US)

( * ) Notice: Subject to any disclaimer, the term of this patent is extended or adjusted under 35 U.S.C. 154(b) by 113 days.

(21) Appl. No.: 16/498,647

(22) PCT Filed: Apr. 13, 2018

(86) PCT No.: PCT/US2018/027451

§ 371 (c)(1),
(2) Date: Sep. 27, 2019

(87) PCT Pub. No.: WO2018/191592

PCT Pub. Date: Oct. 18, 2018

(65) Prior Publication Data

US 2020/0103171 A1 Apr. 2, 2020

Related U.S. Application Data

(60) Provisional application No. 62/485,526, filed on Apr. 14, 2017.

(51) Int. Cl.
*F27D 1/00* (2006.01)
*E04B 2/18* (2006.01)
(Continued)

(52) U.S. Cl.
CPC ..... *F27D 1/004* (2013.01); *F27D 1/0006* (2013.01); *F27D 1/04* (2013.01); *F27D 1/147* (2013.01); *E04B 2/18* (2013.01); *F27D 1/1621* (2013.01)

(58) Field of Classification Search
CPC . F27D 1/004; F27D 1/147; F27D 1/04; F27D 1/0006; F27D 1/1621; F27D 1/08;
(Continued)

(56) References Cited

U.S. PATENT DOCUMENTS 1,773,729 A * 8/1930 Hall ..... F23M 5/00 52/566
2,241,169 A * 5/1941 Yokes ..... E04B 1/12 52/223.7
(Continued)

FOREIGN PATENT DOCUMENTS

CN 1476350 A 2/2004
CN 102575850 A 7/2012
(Continued)

OTHER PUBLICATIONS

Chinese Office Action and English Translation thereof for corresponding CN Application No. 201880024551.8 dated Oct. 30, 2020, 7 pages.
(Continued)

*Primary Examiner* — Jessie T Fonseca
(74) *Attorney, Agent, or Firm* — Hoffman Warnick LLC

(57) ABSTRACT

A refractory insert is provided, including a main body part having a first surface defining a first sidewall, an opposed second surface defining a second sidewall, and an outer peripheral surface separating the first and second surfaces, and a mechanical mating member provided on at least a portion of the outer peripheral surface thereof. The mechanical mating member includes a retention mechanism for
(Continued)

controlling and retaining a position of a corresponding mating member in connection therewith.

17 Claims, 19 Drawing Sheets

(51) Int. Cl.
*F27D 1/04* (2006.01)
*F27D 1/14* (2006.01)
*F27D 1/16* (2006.01)

(58) Field of Classification Search
CPC ..... F27D 1/02; E04B 2/18; E04B 2/14; E04B 2/16; E04B 2/02; F23M 5/02; F23M 5/06; F23J 11/12; F23J 11/022; F28F 9/26
See application file for complete search history.

(56) References Cited

U.S. PATENT DOCUMENTS 2,532,990 A * 12/1950 Blaha ..... F23M 5/025 431/348
3,568,611 A 3/1971 Konrad
4,646,486 A * 3/1987 Hauff ..... H02G 3/22 52/1
4,682,472 A * 7/1987 Huard ..... F16L 37/146 136/204
5,240,404 A * 8/1993 Hemsath ..... F23M 5/025 239/399
5,647,432 A 7/1997 Rexford et al.
5,676,540 A 10/1997 Williams et al.
6,138,426 A 10/2000 Mork et al.
6,267,066 B1 * 7/2001 Schickling ..... F22B 37/108 110/324
8,439,102 B1 * 5/2013 Collins, III ..... F28F 19/002 165/134.1
8,833,013 B2 * 9/2014 Harman ..... F16L 3/003 52/220.8
8,833,478 B2 * 9/2014 Zernach ..... F16L 5/04 169/48
10,190,822 B2 * 1/2019 Collins, III ..... F28C 3/02
10,605,456 B2 * 3/2020 Russell ..... F23M 5/06
2004/0056112 A1 3/2004 Faye et al.
2006/0242914 A1 11/2006 Stephansky et al.
2008/0088128 A1 * 4/2008 Staskal ..... E03C 1/122 285/230
2008/0169578 A1 7/2008 Crane et al.
2011/0088342 A1 * 4/2011 Stahl, Sr. ..... H02G 3/0418 52/220.8
2015/0047276 A1 * 2/2015 Gandolfo ..... H02G 3/22 52/220.8
2016/0153589 A1 * 6/2016 Schwinning ..... E04C 2/521 52/220.8
2017/0080398 A1 3/2017 Russell et al.

FOREIGN PATENT DOCUMENTS

EP 3374716 9/2018
WO 2015/188030 A1 12/2015
WO 2017/058744 A2 4/2017
WO 2017/083506 A1 5/2017

OTHER PUBLICATIONS

Examination Report and English Translation thereof for corresponding IN Application No. 201947040995 dated Nov. 10, 2020, 7 pages.
International Search Report and Written Opinion, International Application No. PCT/US2018/027451, dated Jul. 10, 2018 (13 pages).
International Preliminary Report on Patentability, International Application No. PCT/US2018/027451, dated Oct. 15, 2019 (10 pages).
Canadian Examination Report for corresponding Canadian Patent Application No. 3,056,264 dated Dec. 1, 2020, 3 pages.
European Search Report for corresponding European Patent Application No. 18784411.3 dated Oct. 30, 2020, 7 pages.
CA Office Action for corresponding Canadian Patent Application No. 3,056,264 dated Jun. 3, 2021, 3 pages.

* cited by examiner

RETENTION MECHANISM FOR REFRACTORY INSERTS FOR REFORMER FLUE GAS TUNNEL

This application claims the benefit under 35 USC § 119(a)-(d) of U.S. Provisional Application No. 62/485,526 filed on Apr. 14, 2017, the entire contents of which are incorporated herein by reference.

FIELD OF THE INVENTION

The present invention relates to a retention mechanism for refractory inserts for refractory blocks and refractory block assemblies including those refractory insert, for use in connection with a refractory tunnel, also known as a reformer flue gas tunnel, of a hydrogen reformer furnace, which is used in steam methane reformer processes. More specifically, the present invention provides an improved retention mechanism for refractory inserts that are installed in refractory blocks to control process parameters, such as to provide improved gas flow control. The refractory inserts and refractory block assemblies including those refractory inserts can be used in connection with any conventional refractory block in any refractory tunnel or array, but are preferably used in connection with a light-weight, free-standing tunnel structure that is constructed without the use of mortar, that better withstands the application of hydrogen reformers, and which includes refractory components having a more mechanically robust design and made of higher performance material than that which has been used heretofore.

BACKGROUND OF THE INVENTION

Refractory orifice inserts (otherwise known as refractory inserts) are used in primary reformer flue gas tunnel system to establish the final hole diameters through which flue gas is channeled from the furnace chamber or radiation zone to the heat recovery section or convective zone of the reformer. A full description of such refractory inserts is provided in PCT/US16/61307, which is incorporated herein by reference.

Prior art refractory orifice inserts are round with a diameter ranging from 3 to 6 inches and fit into a corresponding hole in the sidewall refractory block. The periphery of the refractory insert has a continuous circumferential slot that, at assembly, engages tabs in the inner sidewall of the block hole. Segments of the walls of this circumferential slot are omitted to allow the insert to axially pass by the tabs in the sidewall block hole from either side. Once the tab is near the axial center of the refractory orifice insert circumferential slot, the refractory insert is rotated so that the tabs are captured in the circumferential slot. The insert is then prevented from translating axially in the side block hole by more than the axial clearance between the tabs and the slot. The axial clearance between the walls of the circumferential slot and the tabs to allow for rotation ranges from 0.040" to 0.070". Mortar and/or a ceramic fiber gasket are used to prevent the orifice insert from rotating to the point where the tabs could pass through the omitted segments in the circumferential slot walls allowing the insert to dislodge from hole of the block.

It should be noted, however, that the pressure drop from the flue gas flow imparts an axial force on the refractory orifice inserts that can push them out of the block hole. The sole reliance on the mortar and/or ceramic fiber to prevent over rotation, to the point where the refractory orifice insert can axially pass the tabs, however, is problematic. Additionally, some end users object to the use of mortar and/or ceramic fiber for this purpose. In either case, the loss of one or more orifice inserts is significantly detrimental to system performance. Accordingly, there is a need for an additional means to prevent unwanted rotation and axial displacement in connection with refractory inserts that are installed in the holes of refractory blocks.

SUMMARY OF THE INVENTION

The refractory inserts according to the present invention can be used in conjunction with any opening/through-hole location in any brick of any tunnel system. This provides a modular system and allows for a universal refractory insert-mating tab to be provided on the surface of the openings (through-holes) of blocks (bricks) that can be used in conjunction with any type of refractory insert member in any location in a tunnel. Such flexibility allows the end user to modify the installation of refractory inserts in any manner that they deem necessary, depending on the particular processing concerns that they may face.

To date, the prior art does not include any universally applicable refractory inserts that can be easily installed in the openings in any block in any location(s) desired by the end user and robustly held in place without the use of mortar to control the flow dynamics in any manner that is required for any particular type of application.

The object of the present invention, therefore, is to provide refractory inserts, having an improved retention mechanism, for use in connection with refractory blocks for any tunnel structure, but preferably in connection with a light-weight, free-standing tunnel structure, constructed without the use of mortar, that better withstands the application of hydrogen reformers, using more mechanically robust refractory components that are made of higher performance material. More specifically, it is an object to the present invention to overcome the drawbacks of the prior art by providing one or more refractory inserts that are installed in openings of refractory blocks to provide refractory block assemblies to control processing conditions, such as the gas flow conditions, in such a tunnel system, and which will not be subject to displacement or loss upon experiencing pressure drops.

According to a first aspect of the present invention, a refractory insert is provided, comprising a main body part having a first surface defining a first sidewall, an opposed second surface defining a second sidewall, an outer peripheral surface separating the first and second surfaces, and a mechanical mating member provided on at least a portion of the outer peripheral surface thereof. The mechanical mating member comprises a retention mechanism for controlling and retaining a position of a corresponding mating member in connection therewith.

The mechanical mating member preferably comprises at least two diametrically opposed channels in the outer peripheral surface of the refractory insert, wherein the channels are circumferentially defined by the first and second sidewalls. The retention mechanism comprises a retention projection member that projects axially inward from one of the first and second sidewalls proximate a first end of each channel and a rotational stop member defining an opposed second end of each channel. Preferably, the retention projection member projects into the channel axially from one of the sidewalls of the insert facing upstream.

It is also preferred that the retention mechanism of the mechanical mating member comprises at least two diametrically opposed slots, formed in the surface of at least one of the first and second sidewalls, and open to the respective channels at least at the first ends thereof proximate the retention projection member. Further, the refractory insert preferably comprises installation notches, formed on portions of at least one of the sidewalls, facing downstream and extending diametrically inward toward the opposed sidewall. Preferably, the refractory insert member is a gas flow changing plug having a central opening that can vary in size, or be closed off entirely (i.e., no central opening).

According to a second aspect of the present invention, a refractory block assembly is provided, comprising a refractory block having at least one opening (through-hole) formed therein, and at least one refractory insert that resides within the at least one opening (through-hole) in the refractory block. The at least one refractory insert preferably comprises a main body part having a first surface defining a first sidewall, an opposed second surface defining a second sidewall, and an outer peripheral surface separating the first and second surfaces, and a mechanical mating member provided on at least a portion of the outer peripheral surface thereof. The mechanical mating member comprises a retention mechanism for controlling and retaining a position of a corresponding mating member provided on an inner surface of the opening in the block.

Preferably, the retention mechanism of the mechanical mating member comprises at least two diametrically opposed channels in the outer peripheral surface of the refractory insert, the channels being circumferentially defined by the first and second sidewalls, and the retention mechanism preferably comprises a retention projection member that projects into the channel axially inward from one of the first and second sidewalls proximate a first end of each channel, and a rotational stop member defining an opposed second end of each channel. It is also preferred that the refractory insert member is a gas flow changing plug having a central opening that can vary in size, or be closed off entirely (i.e., no central opening).

According to another aspect of the present invention, a refractory block assembly for a steam reformer furnace tunnel is provided. The refractory block assembly comprises a refractory block having a hollow main body portion having an outer peripheral surface defining a first end, an opposed second end, an upper surface, an opposed lower surface, a first side and an opposed second side, at least one through-hole having openings formed in the first side and the opposed second side of the main body portion, and a refractory insert that resides within at least one of the at least one though-hole. The refractory insert comprises a main body part having a first surface defining a first sidewall, an opposed second surface defining a second sidewall, and an outer peripheral surface separating the first and second surfaces, and a mechanical mating member provided on at least a portion of the outer peripheral surface thereof. The mechanical mating member comprises a retention mechanism for controlling and retaining a position of a corresponding mating member provided on an inner surface of the at least one through-hole. The refractory block further comprises at least one first mechanical mating portion defining a protruded portion extending from a portion of the upper surface of the main body portion, and at least one second corresponding mechanical mating portion defining an opening corresponding to the protruded portion formed in a portion of the lower surface the main body portion.

Preferably, the retention mechanism of the mechanical mating member of the refractory insert comprises at least two diametrically opposed channels in the outer peripheral surface of the refractory insert, the channels being circumferentially defined by the first and second sidewalls, and the retention mechanism comprises a retention projection member that projects into the channel axially inward from one of the first and second sidewalls proximate a first end of each channel and a rotational stop member defining an opposed second end of each channel.

According to another aspect of the present invention, a refractory tunnel assembly for a steam reformer tunnel is provided, comprising a plurality of refractory base components, a plurality of refractory wall blocks, wherein at least a portion of the plurality of refractory wall blocks further comprise at least one through-hole defining openings formed in opposed side surfaces thereof, a plurality of refractory lid components, and at least one refractory insert residing within at least one of the though-holes in the refractory wall blocks. The refractory insert has a main body part having a first surface defining a first sidewall, an opposed second surface defining a second sidewall, and an outer peripheral surface separating the first and second surfaces, and a mechanical mating member provided on at least a portion of the outer peripheral surface thereof. The mechanical mating member of the refractory insert comprises a retention mechanism for controlling and retaining a position of a corresponding mating member provided on an inner surface of the one or more through-holes of the wall block. The refractory base components are arranged to extend in a horizontal arrangement direction defining a width of the tunnel assembly and a longitudinal arrangement direction defining a length of the tunnel assembly. The refractory wall blocks are stacked upon the base components in a vertical arrangement direction and along the longitudinal arrangement direction, and are stacked upon one another in both the vertical and longitudinal arrangement directions to define two parallel tunnel walls, spaced a distance apart from one another in the horizontal arrangement direction. The tunnel walls extend upwardly from the refractory base components in the vertical arrangement direction and along the length of the tunnel assembly on the refractory base components. The plurality of refractory lid components are stacked upon the wall blocks in the vertical arrangement direction and along the longitudinal arrangement direction, so that the refractory lids extend along the longitudinal arrangement direction and the horizontal arrangement direction in order to cover the distance between the tunnel walls along at least a portion of the length of the tunnel assembly.

Preferably, the plurality of refractory base components comprises hollow refractory base components, and each hollow refractory base component comprises a plurality of corresponding mechanical mating members. Preferably, the plurality of refractory wall blocks comprises a plurality of hollow refractory wall blocks, each hollow refractory wall block comprising a plurality of corresponding mechanical mating members that further correspond to the mechanical mating members of the hollow refractory base components. It is preferred that the plurality of refractory lid components are hollow refractory lid components, wherein each hollow refractory lid component comprises a plurality of mechanical mating members that further correspond to the mechanical mating members of the hollow refractory base components and the hollow refractory wall blocks. Preferably, the hollow refractory wall blocks are stacked upon and mechanically interconnected to the refractory base components via the corresponding mechanical mating members in the vertical arrangement direction and along the longitudinal arrangement direction, and are stacked upon one another and mechanically interconnected to another via the corresponding mechanical mating members, without the use of mortar, in both the vertical and longitudinal arrangement directions, to define the two parallel tunnel walls that are spaced apart from one another in the horizontal arrangement direction. It is also preferred that the plurality of hollow refractory lid components are stacked upon and mechanically interconnected to the hollow refractory wall blocks via the mechanical mating members, without the use of mortar, in the vertical arrangement direction and along the longitudinal arrangement direction, so that the hollow refractory lids extend along the longitudinal arrangement direction and the horizontal arrangement direction. It is also preferred that the refractory base components, the refractory wall blocks, the refractory lid components, and the refractory inserts all comprise the same material.

The retention mechanism of the mechanical mating member of the refractory insert member preferably comprises at least two diametrically opposed channels in the outer peripheral surface of the refractory insert, the channels being circumferentially defined by the first and second sidewalls, and wherein the retention mechanism comprises a retention projection member that projects axially inward from one of the first and second sidewalls proximate a first end of each channel and a rotational stop member defining an opposed second end of each channel. It is preferred that the retention projection member projects axially inward from one of the refractory insert sidewalls of the insert facing upstream. The mechanical mating member of the refractory insert preferably comprises at least two diametrically opposed slots, formed in the surfaces of the first and second sidewalls, and open to the respective channels.

While the refractory insert according to the present invention are preferably used in conjunction with the reduced-weight refractory blocks according to U.S. patent application Ser. No. 15/307,054, the entirety of which is incorporated herein, it should be noted that the refractory inserts according to the present invention can likewise be readily inserted in conjunction with any standard refractory brick (blocks) having the requisite through-hole, and can likewise be used in any standard refractory brick tunnel. In that case, for example, a standard brick or a pre-cast brick sized piece can be modified to include a through-hole having a mechanical mating feature (e.g., a tab) that is either pre-formed on (i.e., machined or cast) or later added onto (adhered) the inner surface thereof to engage the refractory insert member in the same manner described herein.

Proper material selection and installation procedures are also important to prevent "snaking." Many materials will increase in overall dimension when re-heated, increasing variability and adding challenge to the thermal expansion management. Because the coefficient of thermal expansion for refractory components is nonlinear, it must be fully characterized and understood to ensure that proper expansion joints are created. Selecting a suitable material has always been about compromise and sacrifice in connection with conventional tunnel designs. That is, conventionally, bricks that have sufficient insulating value to keep the furnace supports from deforming do not always also have enough strength to adequately support the tunnel system, and bricks with higher strengths do not have the required insulating value. Conventional materials include various types of fire bricks and super duty brick.

The coefficient of thermal expansion (CTE) for the selected material should not simply be assumed as a linear function for the materials used in the tunnel system. Having a fully characterized CTE is preferable for ensuring that the expansion behavior is properly managed. This becomes even more critical when the thermal expansion is managed on a single component level. Proper material selection preferably includes confirming that the modulus of rupture at the service and excursion temperatures of the furnace has a sufficient safety factor when compared to the associated static load stresses. Selecting a material with an improved HMOR provides immediate increases to the safety factor in the system. Knowing the room temperature MOR of a refractory material alone is not sufficient for proper design of a tunnel system.

In addition, any material being selected for use in a reformer furnace should preferably have the highest resistance to creep reasonably available, as a reduced creep will prolong the life of the tunnel system and prevent premature failures. The use of a material with improved creep resistance reduces the tension on the bottom side of the top lids, and reduces the outward force that the top lids exert onto the brick walls of the tunnel, which is preferred. Using a material having a fully characterized CTE, higher HMOR, and increased creep resistance together improves the overall reliability of the tunnel system.

In view of the above, in the present invention, suitable materials for the refractory inserts, refractory bricks (blocks), refractory bases, and refractory covers (lids) include, but are not limited to alumina-based refractory materials, cordierite (magnesium aluminum silicate), and zirconia, for example. More preferably, the blocks, lids and bases are made from a material selected from the group consisting of medium duty fire clay brick (Oxide Bonded Alumina comprised of at least 30% alumina by weight), high duty fire clay brick (Oxide Bonded Alumina comprised of at least 35% alumina by weight), super duty fire clay brick (Oxide Bonded Alumina comprised of at least 40% alumina by weight), and high alumina fire clay brick (Oxide Bonded Alumina comprised of at least 60% alumina by weight). Most preferably, the present invention utilizes Mullite Bonded Alumina comprised of 88% alumina by weight or an Oxide Bonded Alumina comprised of 95% alumina by weight.

The refractory inserts according to the present invention could conceivably encompass any desired type of component, including but not limited to flow constricting/restricting plugs, flow directing cups and cradles for cross beam supports (i.e., tie bars), and can be easily added to the blocks (to define a block assembly) or removed from the blocks without limiting access to other tunnel components during turnarounds, ensuring that repairs can be complete and effective. Faster installation and repair time also allows for proper repairs to be made more readily, improving the overall reliability of the system.

The present invention takes into account the mechanical features with respect to the interaction between the orifice insert and the side block tabs, and utilizes the axial force imparted on the insert (in service) by the pressure drop of the flue gas passing through it, with the addition of an axial projection from the upstream wall of the channel of the insert, to prevent unwanted rotation leading to disassembly. This pressure typically ranges from 1 inch $H_2O$ to 10 inches $H_2O$.

The retention mechanism according to present invention provides a discontinuity of the circumferential channel of the refractory insert at the end of the opening (slot) in the channel sidewall. This provides a definitive rotational stop for the insert as the channel discontinuity contacts the inserted tab from the block hole. One end of the opening includes a stop wall (rotational stop), and the other end includes an axial projection extending into the channel from the upstream inside wall of the channel, which narrows the gap to just permit the tab to pass therethrough upon the initial installation rotation, but which prevents counter-rotation.

The axial retention projection preferably extends from the upstream inside wall of the channel, and preferably has dimensions of 0.050" to 0.200". This retention projection member narrows the proximate channel axial width, effectively reducing the axial clearance between the sidewalls of the circumferential channel and the tabs to a minimal level that will still allow for rotation upon installation. This clearance ranges from 0.010" to 0.020".

The refractory insert is oriented so that the slots in the sidewall of the channel align with the tabs, and is installed from the downstream side of the block, ensuring that the retention projection is oriented (faces) upstream. The refractory insert is inserted into the hole of the block axially until the tabs of the block (in the hole of the block) are in contact with the continuous downstream inside wall of the insert circumferential channel. The refractory insert is then rotated at least until the tabs of the block enter the openings of the channel and clear past the retention projections proximate thereto, after which the refractory insert is pulled axially in the direction of flue gas flow to seat the tabs in the channel in the space between the rotational stop and the retention projection. In operation, the force exerted by the pressure drop across the refractory insert will maintain this axial position. While it is not necessary, mortar and/or ceramic fiber could still be used for extra security, if desired.

The refractory inserts having the retention mechanism according to the present invention can be readily removed and or replaced with another refractory insert having a different configuration (i.e., a different central ring size opening or a solid puck) after the original installation, if it is deemed necessary by the end user to alter the flow dynamics. Providing universal, modular refractory inserts and refractory block assemblies that can be used in connection with any type of refractory block further enables end users to modify any tunnel system and custom tailor the flow dynamics according to their particular needs. The prior art fails to provide a refractory insert having such a retention mechanism

BRIEF DESCRIPTION OF THE DRAWINGS

For a better understanding of the nature and object of the present invention, reference should be made to the following detailed description of a preferred mode of practicing the invention, read in connection with the accompanying drawings, in which.

DETAILED DESCRIPTION OF THE INVENTION

Figure 1:
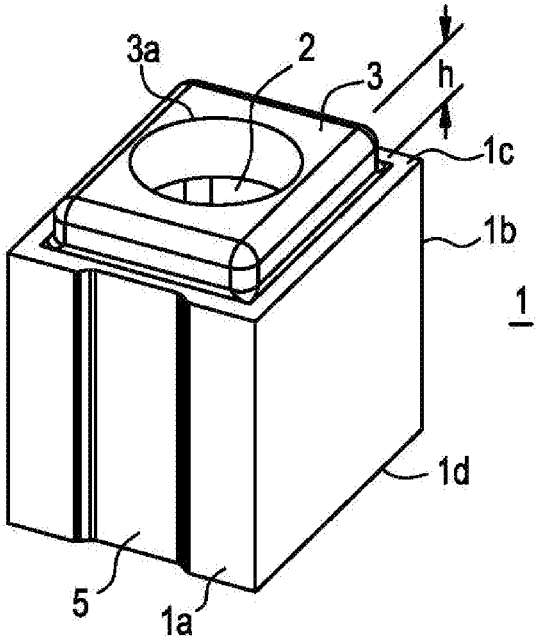
FIG. 1 PRIOR ART
FIG. 1 is a perspective top view of a hollow refractory half block (brick)
Figure 2:
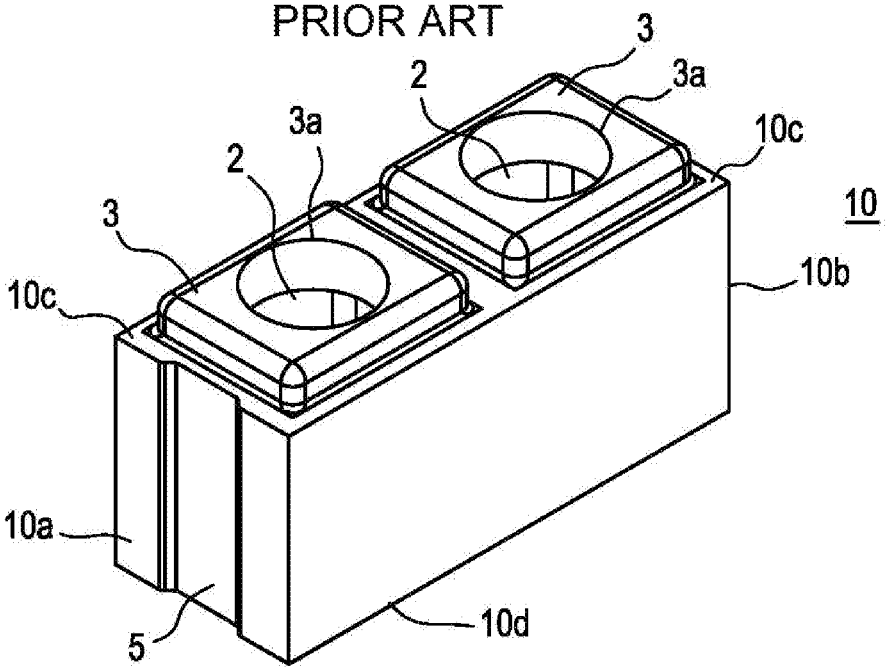
FIG. 2 PRIOR ART
FIG. 2 is a perspective top view of a hollow refractory full block (brick)
Figure 3:
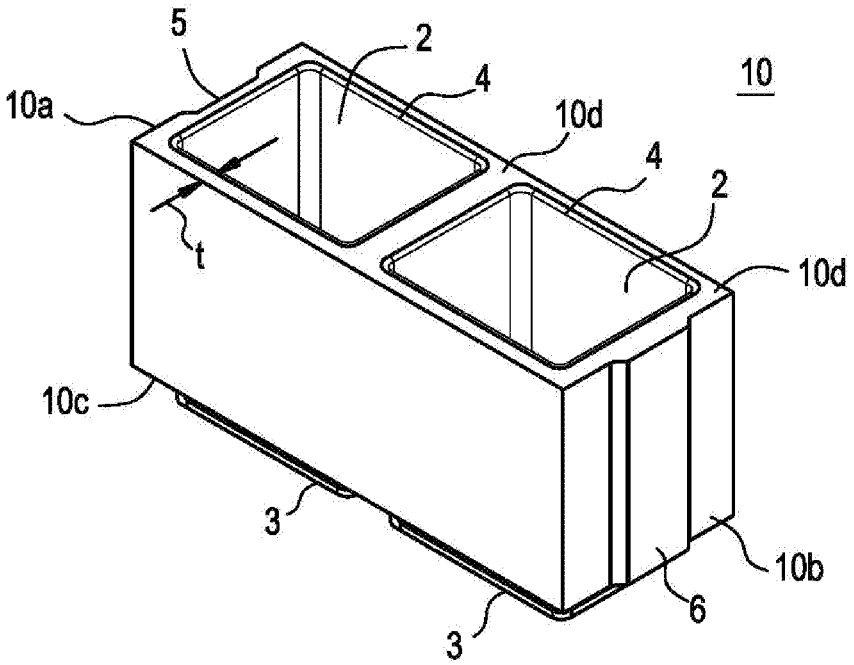
FIG. 3 PRIOR ART
FIG. 3 is a perspective bottom view of the full hollow refractory block shown in FIG. 2.
Figure 4:
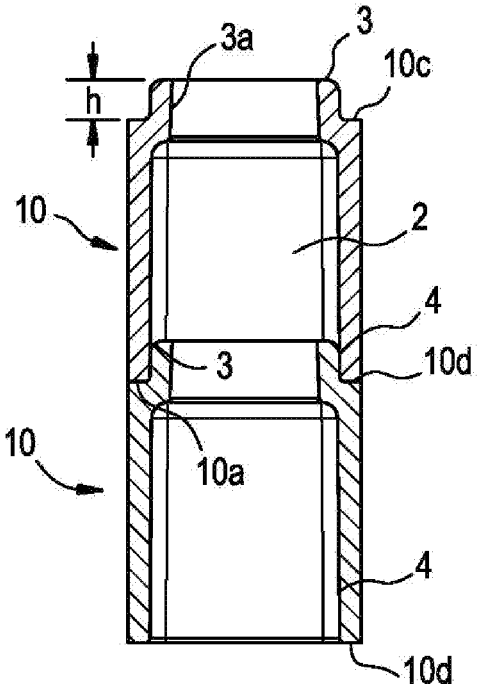
FIG. 4 PRIOR ART
FIG. 4 is a sectional end view of two hollow refractory blocks shown in FIG. 2 in a stacked arrangement.

FIG. 1 shows a "half brick" 1 and FIG. 2 shows a "full brick" 10. FIG. 3 is a bottom view of the full brick 10 shown in FIG. 2. It should be understood that the corresponding bottom view of the half brick 1 shown in FIG. 1 (not shown) would be same as that shown in FIG. 3, only half the size. A standard brick has dimensions of, for example, 6.5 in W×18 in L×10 in T (tall), but the design is applicable for bricks as small as 2 in W×4 in L×2 in T and for bricks as large as 9 in W×24 in L×18 in T, as well. Preferably, each block (brick) has a weight in a range of 20-70 lbs., more preferably 40-50 lbs., so that one person can readily maneuver the blocks alone, while reducing the total number of blocks needed to construct the tunnel wall to the smallest number possible.

It should also be noted that although blocks 1, 10 as shown do not include any through-holes, either type of block 1, 10 can be modified or manufactured to include one or more though-holes, as discussed below in connection with FIGS. 5A-5B. An example of a half-block 1A including at least one though-hole (and having a refractory insert installed therein) is shown and described below in conjunction with the refractory block assemblies and tunnel assembly structure of FIGS. 20-21. Any standard or specialized type refractory block having a through-hole formed therein can be used in connection with the refractory insert according to present invention. For example, a conventional brick (block) including a refractory insert according to the present invention is described below in connection with FIGS. 18 and 19.

Each of the bricks 1, 10 has an outer peripheral surface defining a first end (1*a*, 10*a*), an opposed second end (1*b*, 10*b*), an upper surface (1*c*, 10*c*) and an opposed lower (bottom) surface (1*d*, 10*d*). These bricks 1, 10 are hollowed out to remove all possible material from non-critical areas. Preferably, the wall thickness "t" (see, e.g., FIG. 3) of the walls of these bricks 1, 10 is in a range of 0.5-1.5 in, preferably 0.625-0.875 in. The resultant tunnel assembly has only about 60% of the weight of a conventional tunnel. The hollowed-out portions define one or more, preferably a plurality of cavities 2 in the respective blocks 1, 10.

The upper surfaces 1*c*, 10*c* of the blocks 1, 10 each include a male part of the precision interlocking mechanical mating features of the refractory blocks according to the present invention. The protruding portion 3 is elevated a distance from the surface 1*c*, 10*c* to define a geometrical member that extends from the block 1, 10 and serves as a locking part that fits precisely into the opening 4 formed in the lower surface 1*d*, 10*d* of the blocks 1, 10. As shown, the protruding portion 3 is a substantially rectangular elevation with chamfered corners and a circular opening 3*a* passing through its center and in communication with a cavity 2. The circular opening 3*a* is merely a function of manufacturing and material removal considerations, and is not critical. As shown in FIGS. 1 and 2, the openings 3*a* are in communication with the cavities 2. This is not always the case, however, as described in more detail below.

While the exact shape of the protruding portion 3 is not necessarily limited to the shape shown here, it is preferably a geometric match to the shape of the corresponding opening 4, with a slight off-set to accommodate manufacturing tolerances. The protruding portions 3 of the blocks 1, 10 must fit precisely within the openings 4 of the vertically adjacent blocks 1, 10 to securely engage the vertically adjacent blocks 1, 10 to one another to facilitate the construction of free-standing tunnel walls without the use of mortar. There must also be sufficient tolerance to account for the thermal expansion considerations discussed above, and to maintain contact to prevent buckling.

Figure 13:
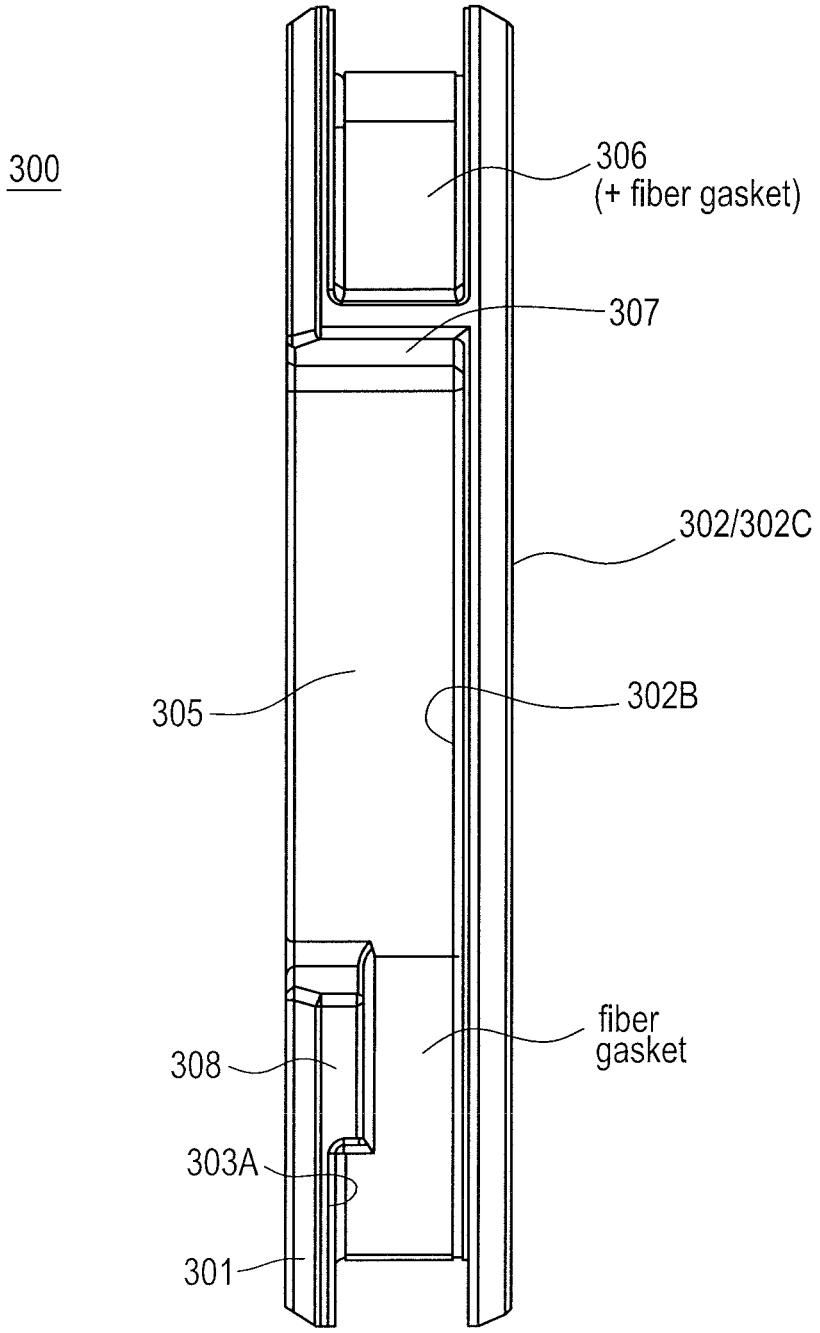
FIG. 13 is a top view of the refractory insert shown in FIGS. 9-12.
Figure 14:
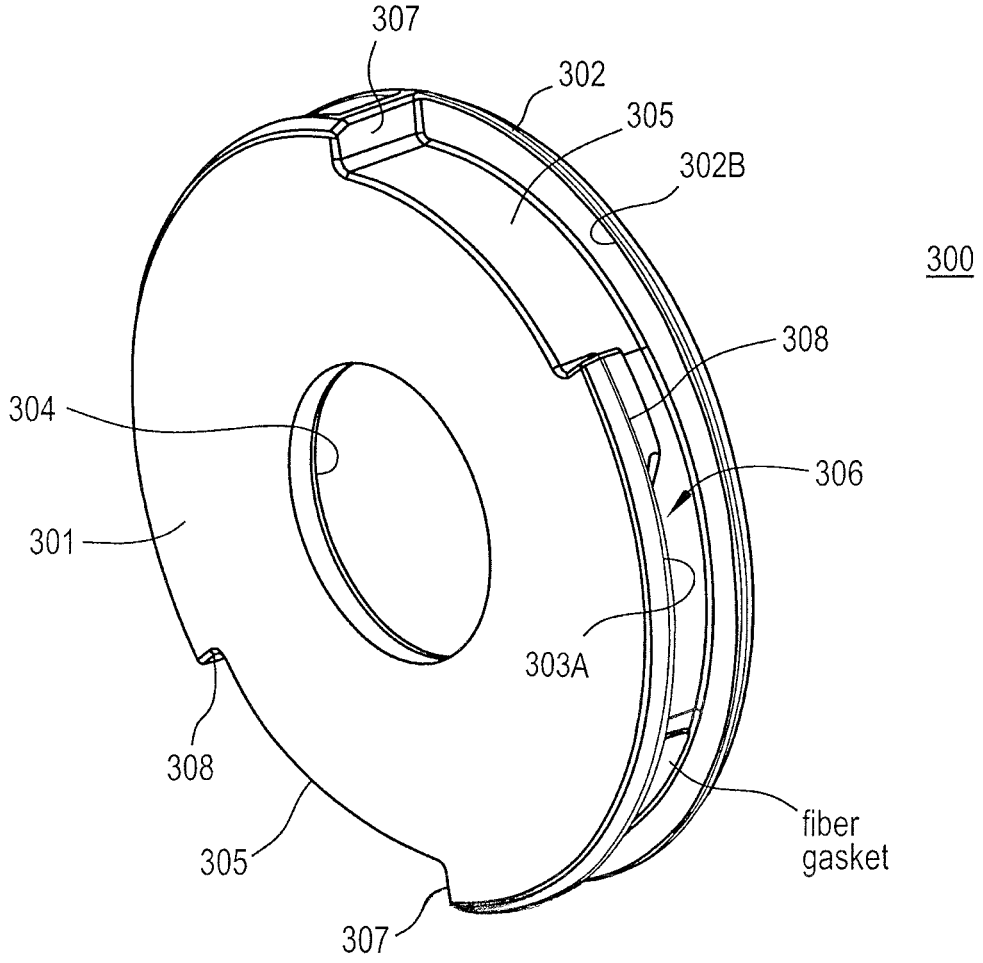
FIG. 14 is an upstream face perspective view of the refractory insert shown in FIG. 9.

The opening 4 communicates with the cavities 2 of the blocks 1, 10, and receives the protruding portion 3 in a tight, interlocking manner to securely connect the blocks 1, 10 to one another, without mortar, in a vertically stacked manner, as shown in FIG. 13. The shape of the opening 4 is not critical, so long as it precisely corresponds in shape and size to the shape and size of the protruding portions 3, in consideration of the mechanical factors and thermal concerns discussed above.

The importance is the geometric match with a slight off-set between the corresponding protruding portion 3 and opening 4 into which the protruding portion 3 fits. Preferably, the off-set is in a range of 0.020 in to 0.060 in. The minimum off-set is dictated by manufacturing tolerance capabilities resulting in block to block variability. There must be sufficient height and tightness to securely engage if buckling occurs. Preferably, the overall height "h" of the protruding portion 3, or distance that the protruding portion 3 extends from the upper surface 1*c*, 10*c* of the blocks 1, 10, is at least 0.75 in, in order to ensure sufficient engagement with the opening 4 and prevent buckling. The dimensions of the opening 4 should be as tight to the protruding portion as possible with allowance for manufacturing variation. Ideally, uniform wall thickness balanced with manufacturing needs governs the dimensions.

The individual blocks 1, 10 further include additional mechanical mating features, such as a tab on one end and a groove on the other end, with a gap provided that allows each block to expand with increasing operating temperature until its seals against the blocks on either side thereof in the horizontal arrangement direction. As shown in FIGS. 1-3, the first sides 1*a*, 10*a* of the blocks 1, 10 include a groove or slot 5, and the opposed second sides 1*b*, 10*b* are formed to include a corresponding "tab" or protrusion 6 that vertically fits into the corresponding groove 5 of a horizontally adjacent block 1, 10. Preferably, the groove is larger than the tab by a minimum of manufacturing variation; preferably, the tab is 30-75% of the overall width of the block.

A compressible high temperature insulation fiber (not shown) can also be provided, placed in the groove 5 in order to reduce gas bypass while accommodating for a range of temperature fluctuations in service. The fiber is specified to have sufficient compression variability so as to reduce gas bypass over a wide range of operating temperatures from 600° C.-1200° C. This fiber can also be used in between layers of blocks to prevent point loading. As discussed below, the base components and top lids (covers) both have a similar tab and groove design, and use either a fiber gasket or a fiber braid to reduce gas bypass over the range of operating temperatures.

Figure 20:
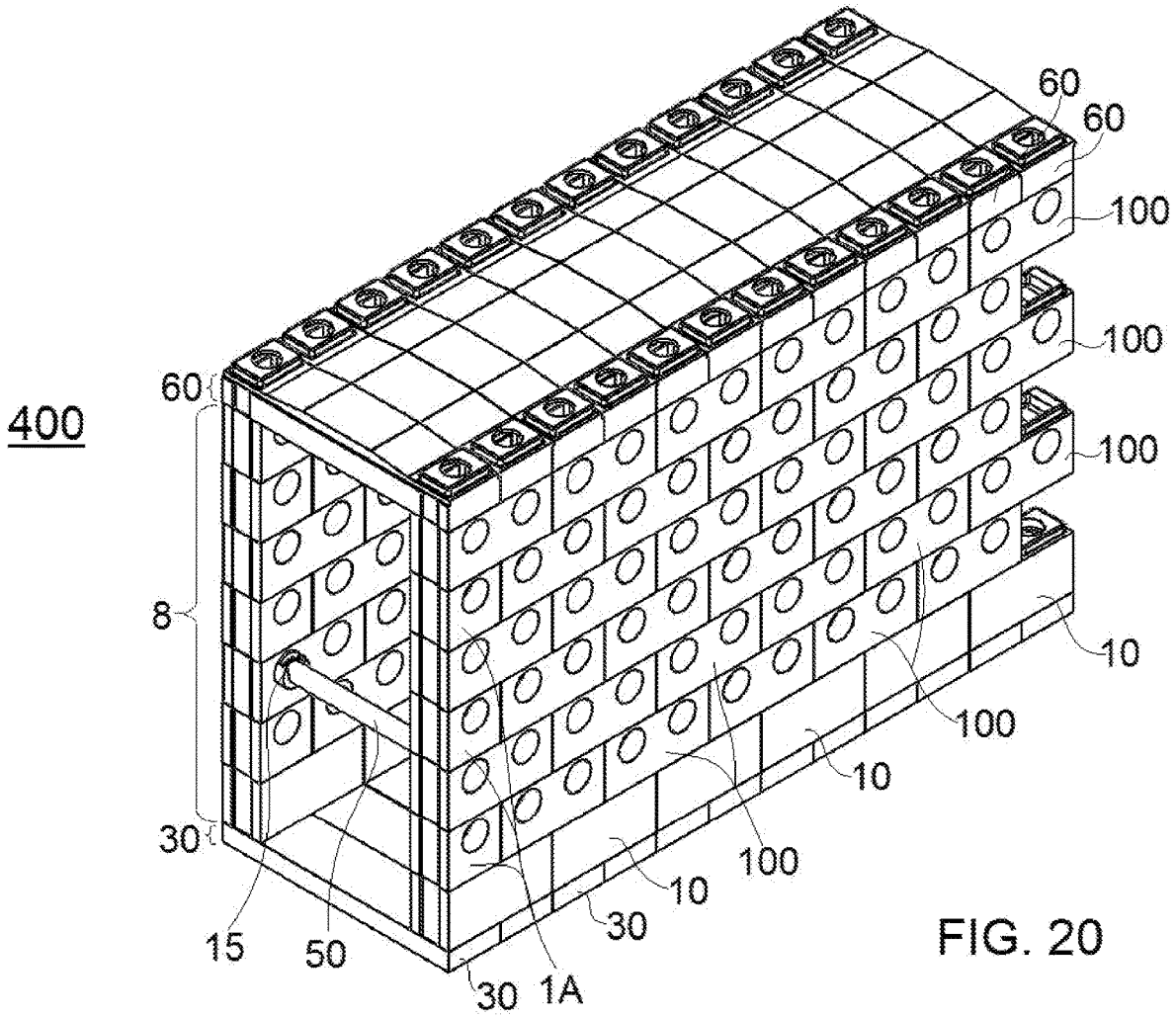
FIG. 20 is a perspective view of a tunnel assembly according to the present invention.

Preferably, as the blocks 1, 10 are arranged in the formation of the tunnel wall, the blocks 1, 10 are horizontally off-set by one-half of a block length, or by one set of mechanical mating features, to increase the mechanical robustness of the arrangement (see, e.g., FIG. 20 in connection with blocks 1A, 10 and 100). This arrangement also helps prevent buckling, which is arrested by virtue of the robust and tight tolerance interlocking mechanical mating feature, so that the rotation of one block relative to a block below it does not cause direct contact between the respective protruding portion 3 and the opening 4 to break.

The mechanical mating features described above add redundancy to the system by mechanically engaging the blocks, which prevents the tunnel wall from leaning and falling over without requiring that mating features be sheared off or otherwise break through the wall of the block to which they are connected.

In order for the tunnel to properly act as a flue for the exit of the furnace, it must have variable inlet conditions (openings in the walls), for example, which typically allow more gas to enter the tunnel farthest from the exit, and less gas to enter the tunnel closer to the exit (or in any manner dictated by the processing concerns). The typical arrangement creates a more uniform distribution of gas and temperature in the furnace. As noted above, conventional tunnel wall designs simply utilize half bricks to create gaps in the walls as various locations. However, such conventional half bricks create unsupported locations on top of the square openings, creating locations for failures.

Figure 5A:
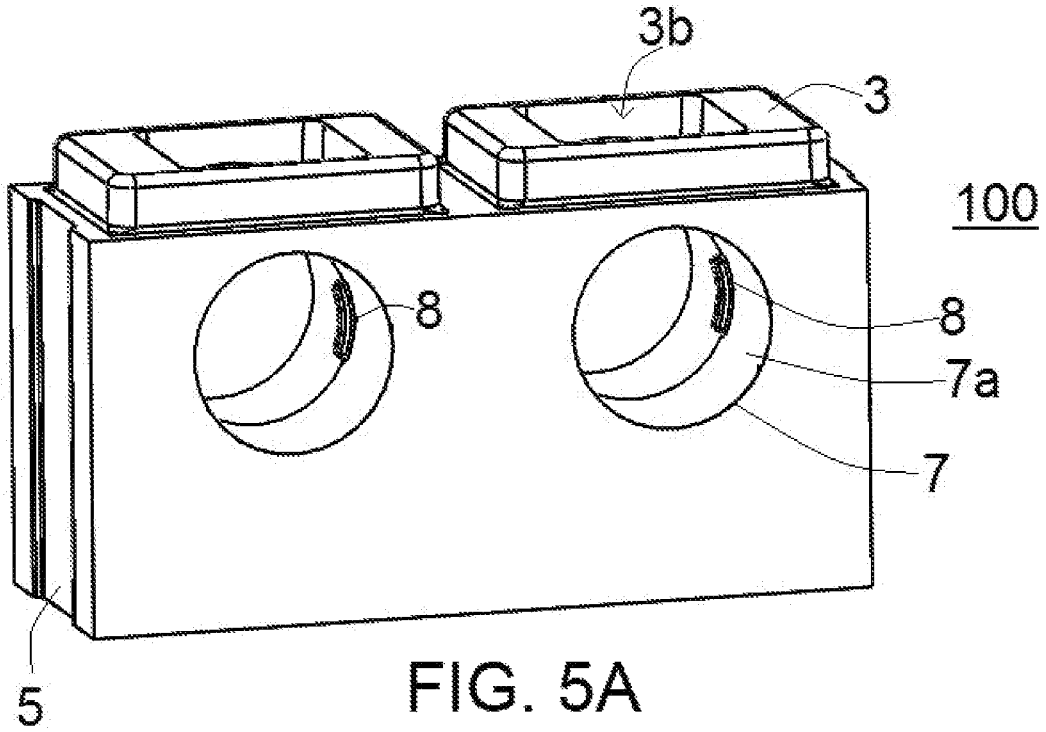
FIG. 5A PRIOR ART
FIG. 5A is perspective views of a hollow refractory full block including at least one though-hole (two as shown) and FIG. 5B is a cut-view of the hollow refractory full block shown in FIG. 5A.
Figure 5B:
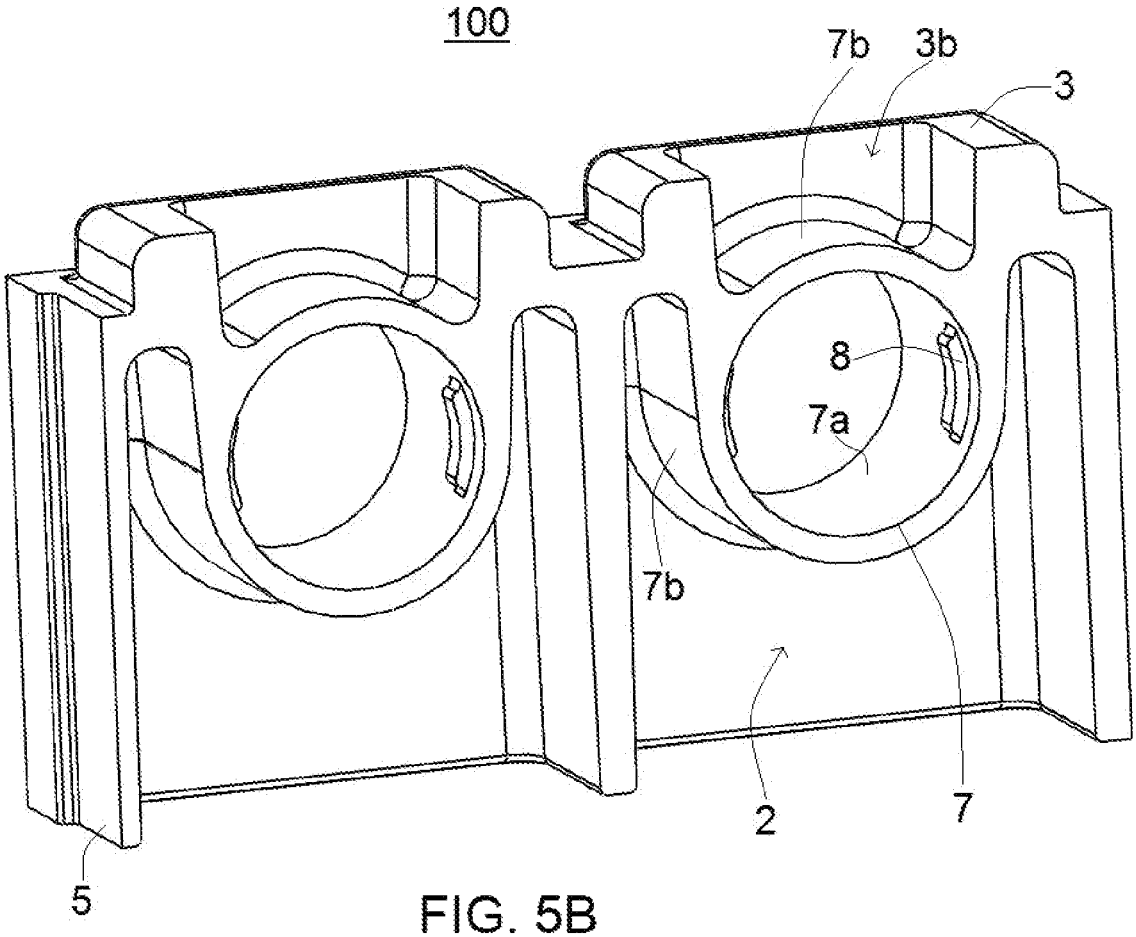
FIG. 5B PRIOR ART
Figure 18:
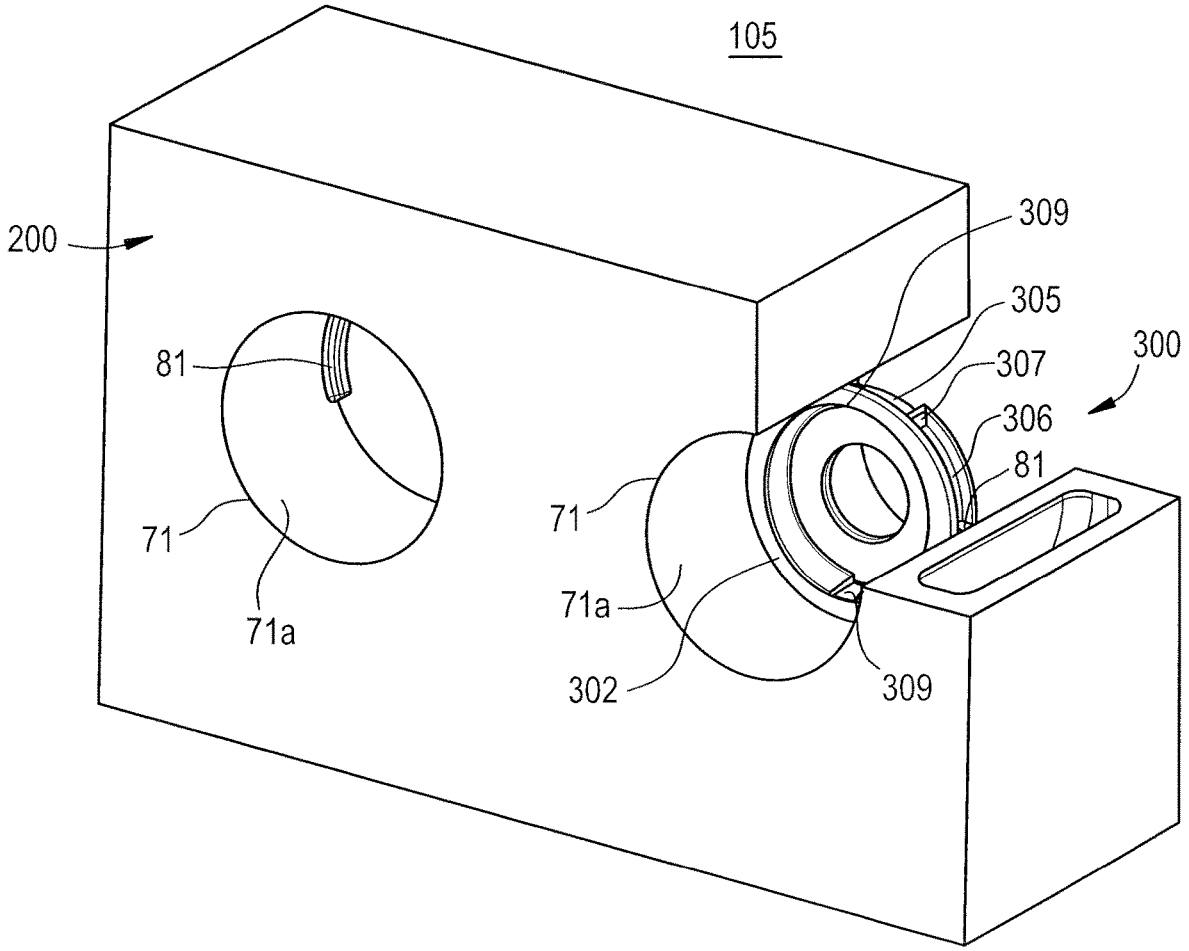
FIG. 18 is a perspective partial cut-view from the downstream side of an assembly according to the present invention, including a conventional refractory brick (block)
Figure 19:
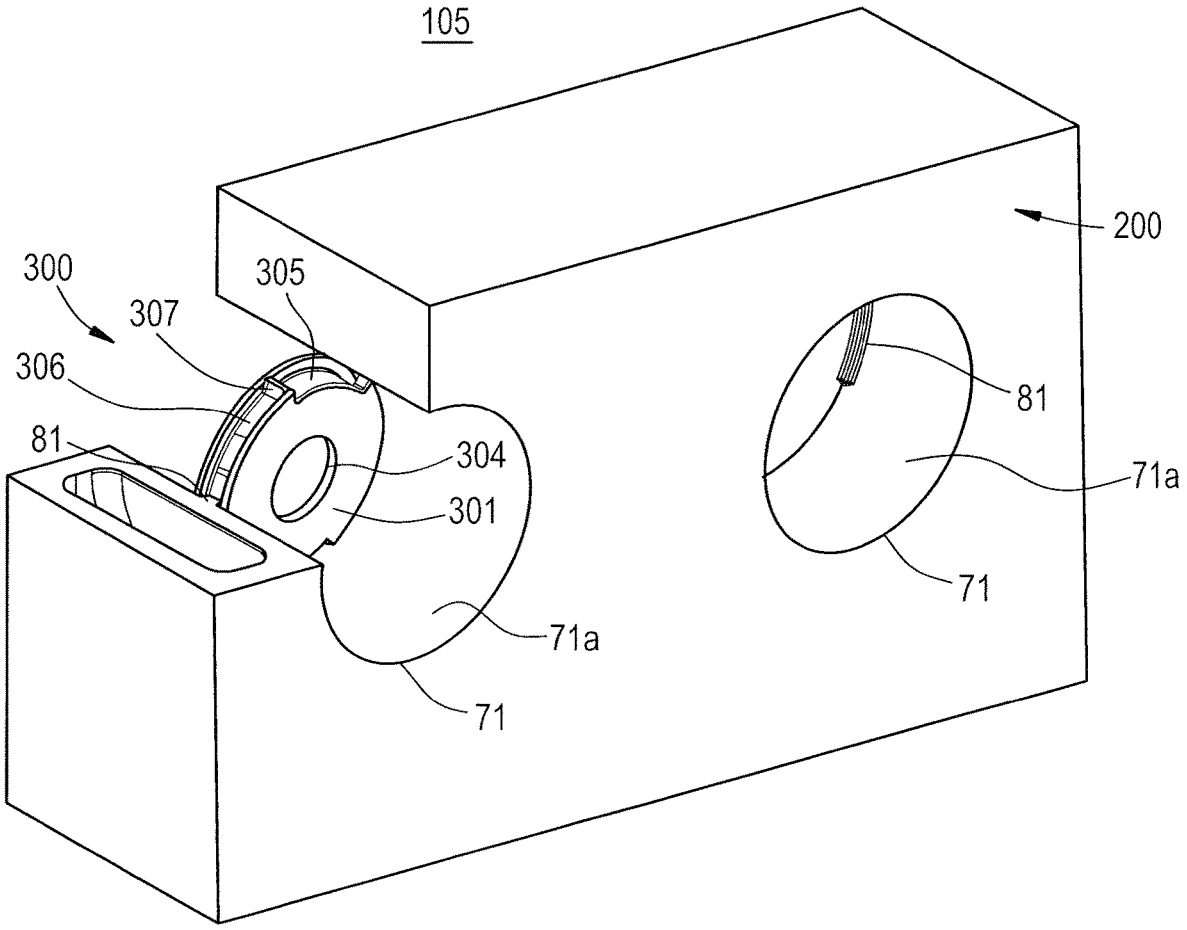
FIG. 19 is a perspective partial cut-away view from the upstream side of the assembly shown in FIG. 18.

As shown in FIGS. 5A-5B, the tunnel system (see FIGS. 20-21) utilizes refractory blocks 1A and 100 that include one or more through-holes 7 formed therein in order to allow gas to enter the tunnel. This design evenly distributes the load created by the through-holes 7 to the surrounding material. The through-holes 7 can be formed when the bricks 1A, 100 are initially formed (e.g., cast), or can be formed later by machining or any suitable process. FIGS. 18 and 19 described below show a standard refractory block 200 having through-holes 71 and tabs 81 that can also be used in connection with the refectory inserts having the retention mechanism according to the present invention to form a tunnel assembly/system.

The block 100 has outer peripheral surfaces defining a first end 100*a*, an opposed second end 100*b*, an upper surface 100*c*, and an opposed lower (bottom) surface 100*d*. Although a full block 100 is shown, it should be understood that a half-block could also be used, which would be the same as block 100, but only half the size (see, e.g., the description in connection with FIGS. 1 and 2). Like the structure shown and described in connection with shown in FIGS. 1-3, the first sides 100*a* of the blocks 100 include a groove or slot 5, and the opposed second sides 100*b* are formed to include a corresponding "tab" or protrusion 6 (not shown) that vertically fits into the corresponding groove 5 of a horizontally adjacent block 100. Preferably, the groove is larger than the tab by a minimum of manufacturing variation; preferably, the tab is 30-75% of the overall width of the block. A compressible high temperature insulation fiber (not shown) can also be provided, placed in the groove 5 in order to reduce gas bypass while accommodating for a range of temperature fluctuations in service. The fiber is specified to have sufficient compression variability so as to reduce gas bypass over a wide range of operating temperatures from 600° C.-1200° C. This fiber can also be used in between layers of blocks to prevent point loading.

Preferably, as the blocks 100 are arranged in the formation of the tunnel wall, the blocks 100 are horizontally off-set by one-half of a block length, or by one set of mechanical mating features, to increase the mechanical robustness of the arrangement (see, e.g., FIG. 20 in connection with blocks 1A and 10). This arrangement also helps prevent buckling, which is arrested by virtue of the robust and tight tolerance interlocking mechanical mating feature, so that the rotation of one block relative to a block below it does not cause direct contact between the respective protruding portion 3 and the opening 4 to break.

The through-holes 7 of the blocks 100 can have any geometry, but preferably have a circular or semi-circular shape. The size of the through-holes 7 can vary from 1 $in^2$ up to substantially to the full size of the block 100, which is typically around 144 $in^2$, but are preferably 12 $in^2$-36 $in^2$. For example, in FIGS. 5A-5B, the though-holes 7 have a dimeter of approximately 4.5 inches. Blocks 100 preferably have one or two through-holes 7 per block, but could have multiple holes in various locations to facilitate the same end result, as desired. These through-holes 7 are preferably closed, i.e., do not communicate with the interconnected internal cavities 2 of the blocks 100 that form an internal area of the tunnel wall, as shown (see FIG. 16), or instead, a number of blocks could have through-holes that are open to the internal area of the tunnel wall.

Figure 16:
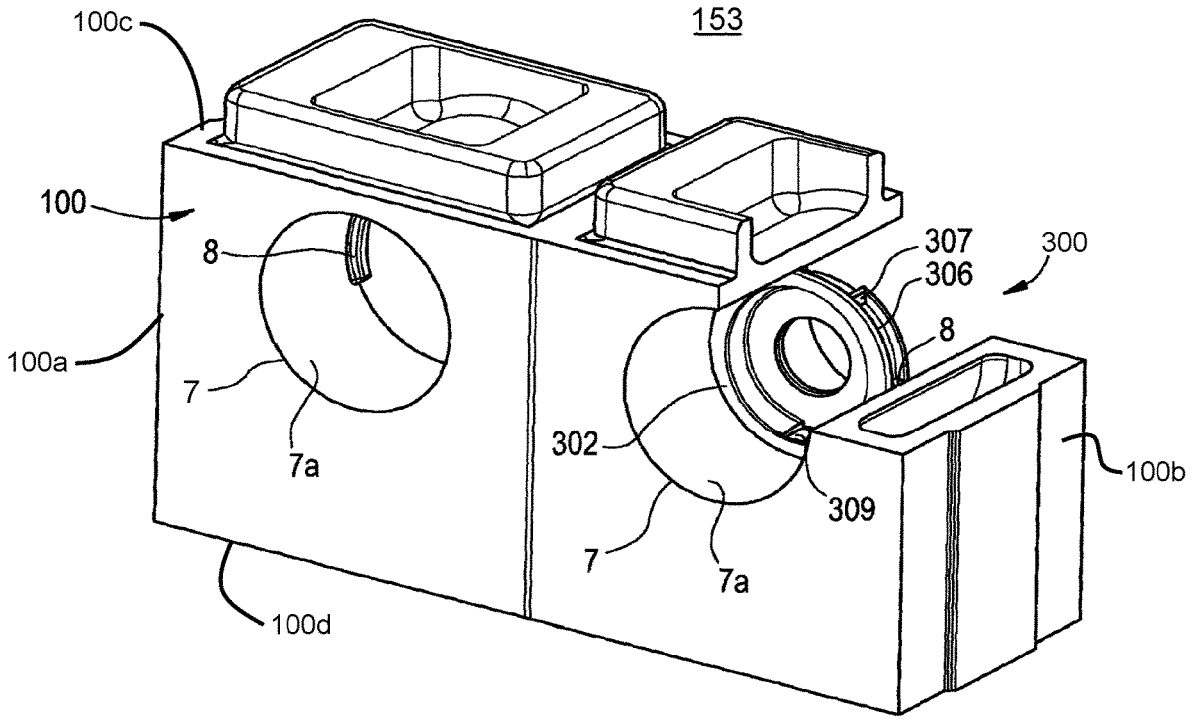
FIG. 16 is a perspective partial cut-away view from the downstream side of the assembly shown in FIG. 15.

As shown in FIGS. 5A-5B, the opening 3*b* in the protruding portion 3 is simply a removed-material portion, and does not communicate with (not in fluid communication with) the cavity 2. As best shown in FIG. 16, the through-hole 7 is like a tube that passes though the cavity 2, but the internal surface 7*a* of the through-hole 7 is not in fluid communication therewith, and the through-hole 7 (though which the gasses pass) is therefore closed to the cavities 2 (and therefore the internal surface area of the tunnel wall) by virtue of the internal surface 7*a* of the through-hole 7.

A mechanical mating member, such as one or more tabs 8, are provided on the inner surface 7*a* (i.e., inner diameter; see FIGS. 5A-5B) of the through-hole 7, to serve as a mechanical fastening feature that interlocks with corresponding mating features provided on the refractory inserts according to the present invention. These tabs 81 can likewise be provided on the inner surface 71*a* of a through-hole 71 of any conventional block, as shown in FIGS. 18-19. As shown in FIGS. 5A-5B, the tabs 8 are preferably located on diametrically opposed portions of the inner surface 7*a* of the through-hole 7. Although the exact dimensions of the tabs 8 are not expressly limited by anything except the corresponding mating geometry of the refractory inserts (described below), these tabs 8 have a preferred dimension of ⅜" high (protruding from the inner through-hole surface 7*a*), ¾" long (axial distance), and 1.75" wide (radially). While the size of the tabs 8 and the shape of the tab 8 can readily be modified, it is preferred that the aspect ratio of 2:1, length:height is maintained. Preferably, the size of the tab 60° or less with respect to the circumference of the inner diameter (inner surface) 7*a* of the through-hole 7, but must necessarily be only slightly less than the corresponding receiving part (opening/slot) on the insert member, in order to by-pass the opening and fit therein or within the receiving groove (once rotated).

Refractory inserts having the retention mechanism according to the present invention are shown and described in connection with FIGS. 9-19.

Figure 9:
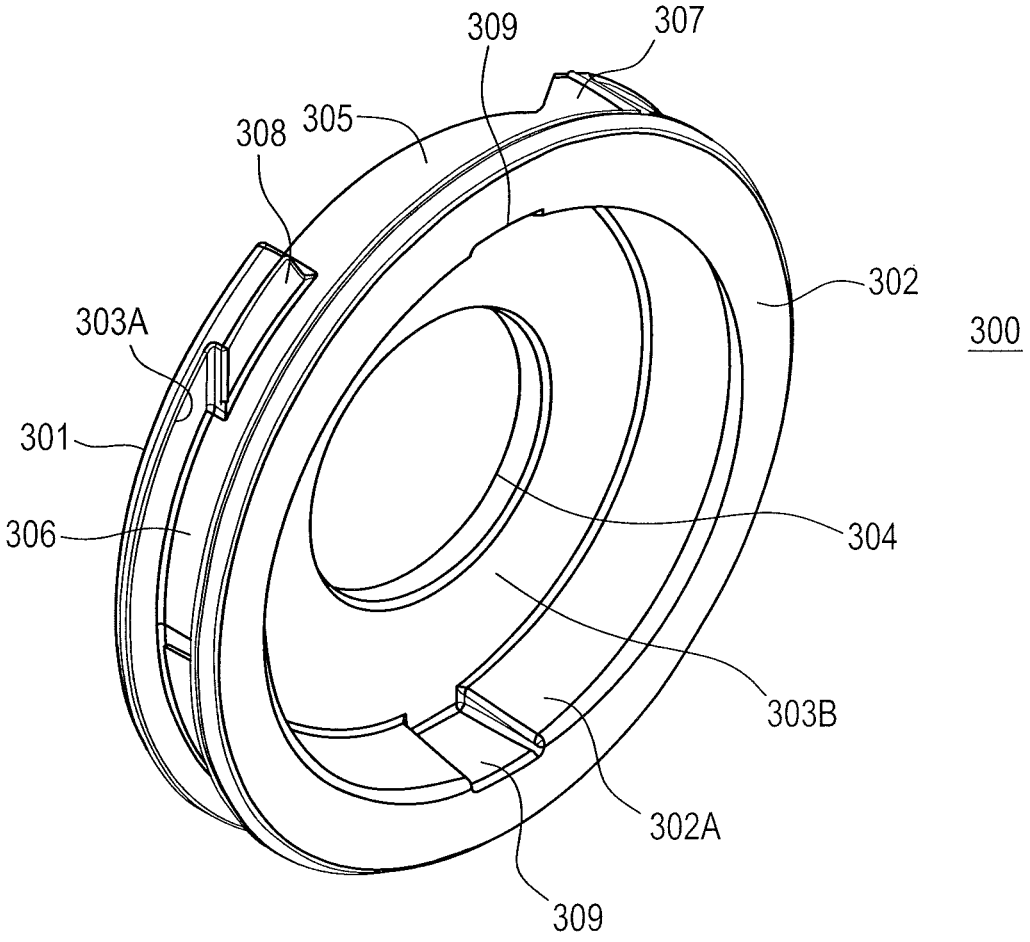
FIG. 9 is a downstream face side perspective view of a refractory insert according to the present invention.
Figure 10:
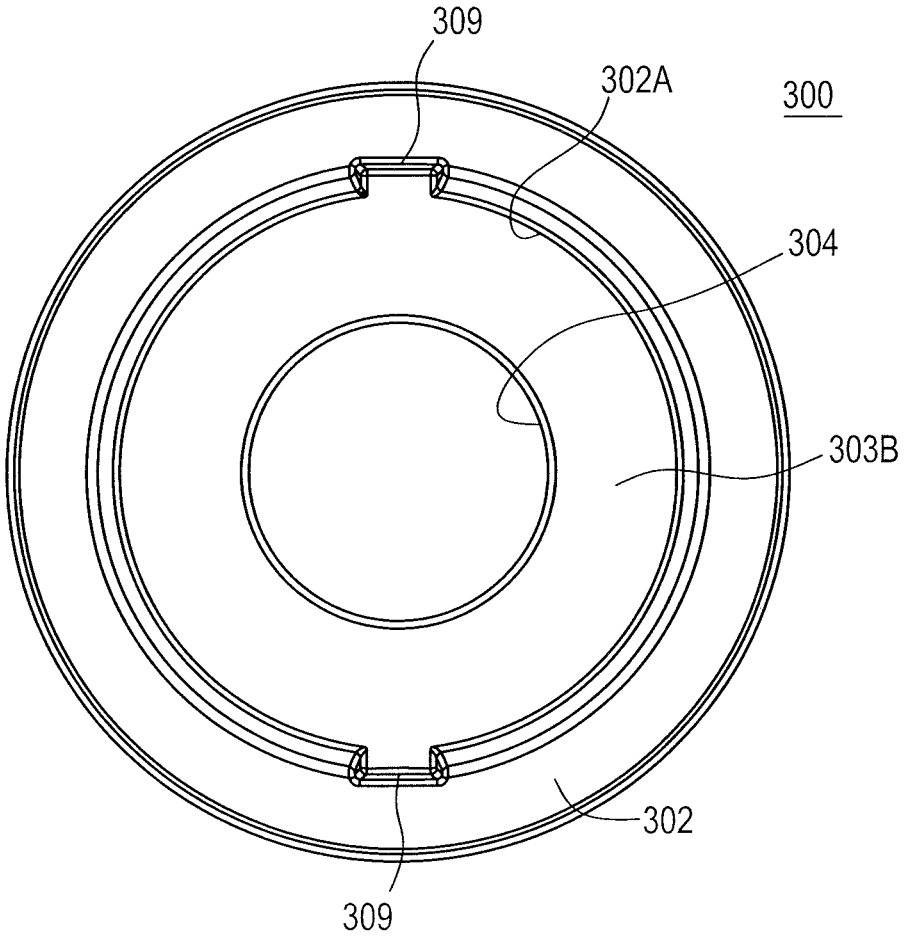
FIG. 10 is a planar view from the downstream surface side of the refractory insert shown in FIG. 9.
Figure 11:
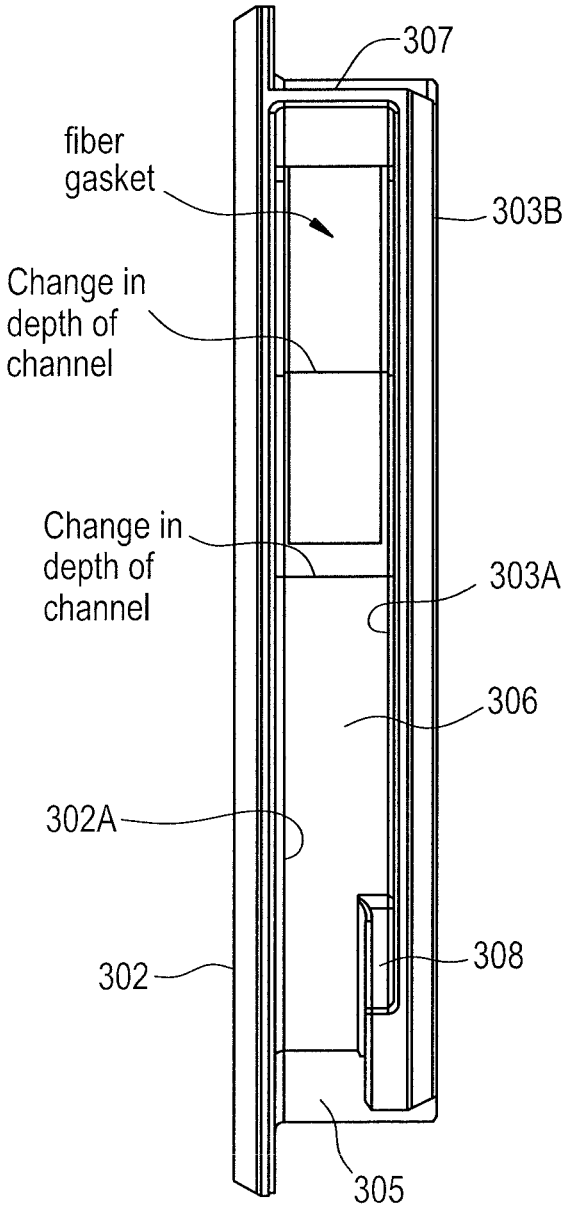
FIG. 11 is a right-hand side view of the refractory insert shown in FIGS. 9 and 10.
Figure 12:
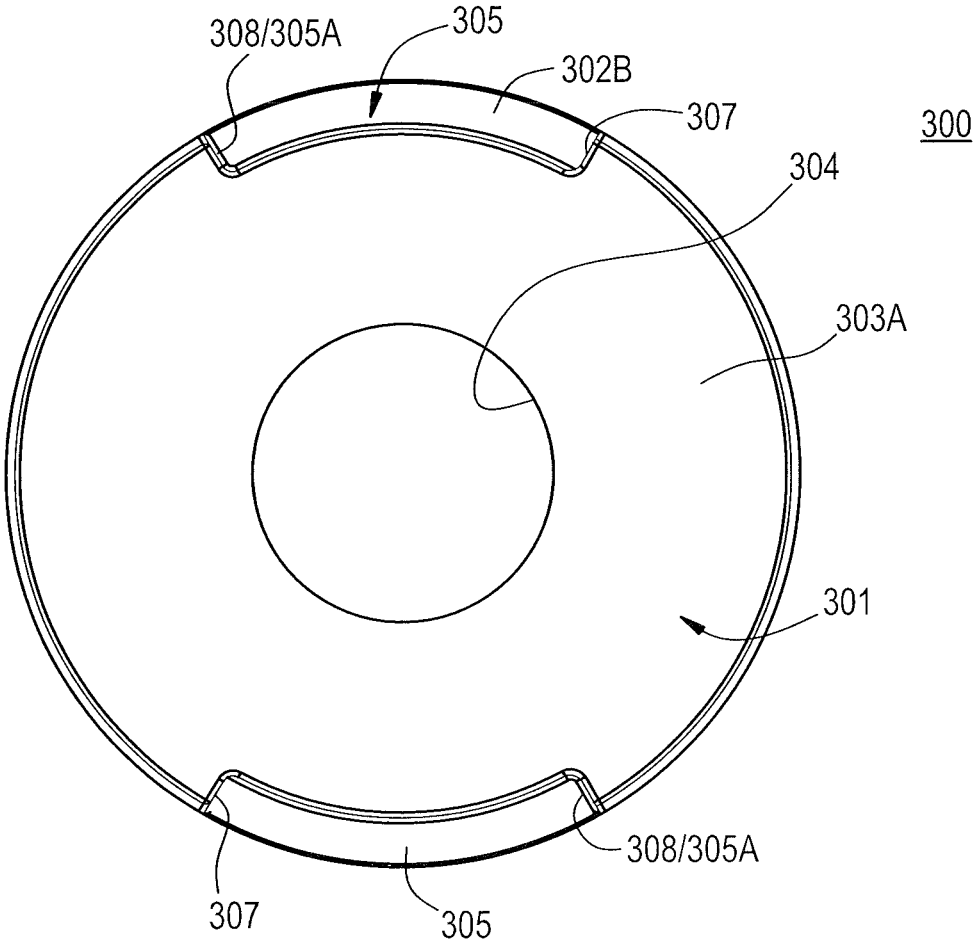
FIG. 12 is a planar view from the upstream face of the refractory insert shown in FIGS. 9-11.

FIG. 9 is a downstream-side perspective view of a refractory insert 300 according to the present invention, FIG. 10 is a planar view from the downstream-side of the refractory insert 300 shown in FIG. 9, FIG. 11 is a right-hand side view of the refractory insert 300 shown in FIGS. 9 and 10, FIG. 12 is a planar view from the upstream-side of the refractory insert 300 shown in FIGS. 9-11, FIG. 13 is a top view of the refractory insert 300 shown in FIGS. 9-12, and FIG. 14 is an upstream-side perspective view of the refractory insert 300 shown in FIG. 9.

As shown in FIGS. 9-14, the refractory insert 300 is a substantially circular member having a truncated cylindrical overall shape. The overall size of the refractory insert is dimensioned to fit within the through-hole of a refractory block with little tolerance, so as to effectively reduce the flow of process gas around the outer circumference thereof. Preferably, the refractory insert 300 is dimensioned to be in a range of 1-12" in diameter, more preferably 3-7". The refractory insert 300 includes a first surface 301 defining an upstream sidewall or surface (i.e., which will be oriented to face upstream in the system once installed in a block), and opposed second surface 302 defining a downstream wall or surface (i.e., which will be oriented to face downstream in the system once installed in a block).

The downstream surface 302 includes an inner surface 302B (facing upstream) and an outer surface (facing downstream) 302C. An inner peripheral sidewall 302A extends between the downstream surface 302 and an inner surface 303B of the upstream surface 301.

The upstream surface 301 includes an outer surface (upstream side) 303A and an opposed inner surface (downstream side) 303B. The upstream surface 301 also includes a central opening 304 passing between the outer surface 303A and the inner surface 303B thereof. The size of the opening 304 can vary in diameter, depending on the desired gas flow characteristics. Typically, the opening is dimensioned to be in a range of 0.25-3". The central opening 304 of the refractory insert 300 is smaller than that of the refractory insert 330 shown in FIG. 21. It is also conceivable that no central opening is provided, in which case the refractory insert would define a gas flow restricting member (plug) when inserted. The outer peripheral surface of the refractory insert 300 includes the retention mechanism according to the present invention. The retention mechanism includes slots 305, channels 306, retention projection members 308 and rotational atop members 307.

Slots 305 are formed in diametrically opposed locations on a sidewall of the refractory insert defining the channel 306, preferably the downstream surface 301, and are sized to permit the tabs 8, 81 of the blocks 100, 200 to fit therein and be accepted into the circumferential channel 306 when the refractory insert 300 is rotated upon installation. Preferably, the dimensions of the slots 305 are 60°. The circumferential channel 306 is defined by an opening 305A of the slot 305 at one end (i.e., a first end) of the channel 306, and a rotational stop 307 at the other end (i.e., a second end) thereof, so that the rotational stop 307 is interposed between the second end of the channel 306 and the opposed slot 305. The retention projection 308 is provided proximate the opening of the slot 305. Preferably, the length of the channel 306 is in a range of 62-120° and the width of the channel is in a range of 0.25-0.75" (based on tab dimensions). As shown in FIG. 11, it is preferred that the depth of the circumferential channel 306 is varied to help guide the tabs 8, 81 into position and hold them snugly in place once the installation rotation is completed. The depth of the channel can vary form an initial depth of 0.30" (closer to the retention projection 308) to an intermediate depth of 0.20", to a final depth of 0.10" (closer to the rotational stop 307). If desired, a fiber gasket can be added prior to installation to help ensure the desired fit and retention in place after the installation rotation is completed. The material of the fiber gasket is preferably any suitable high temperature ceramic fiber.

As noted above, the retention projection 308 extends axially from the upstream inside wall (sidewall) 303A of the first surface 301 defining the channel 306, and preferably has dimensions of 0.050" to 0.200". This retention projection 308 narrows the proximate axial width of the channel 306, effectively reducing the axial clearance between the sidewalls of the circumferential channel 306 (i.e., the inner wall 303 B of the surface 302 and outer surface 302B of surface 302) and the tabs 8, 81 to the minimal level that will still allow for rotation. This clearance ranges from 0.010" to 0.020".

In the refractory insert 300, at least one notch 309, preferably two diametrically opposed installation notches 309, are provided in the outer surface 302C of the downstream surface 302 and along a portion of the sidewall 302A to facilitate rotation of the refractory insert upon installation. An installation tool (not shown) having a T-shaped body is used to engage the two notches 309 and rotate the refractory insert into place in the through-hole 7, 71 of a refractory block 100, 200, as shown in FIGS. 15-19. Preferably, the notches 309 are dimensioned to be 0.375".

Upon installation, the refractory insert 300 is positioned so that the slots 305 align with the tabs 8, 81 of the respective block 100, 200. As the refractory insert 300 is rotated, the tabs 8, 81 positioned within the slot 305 will tightly pass the retention projection 308 and then reside within a portion of the circumferential channel 306 between the retention projection 308 and the rotational stop 307. Counter-rotation is not permitted by virtue of the tight dimensional tolerances of the retention projection 308, and over-rotation is prevented by the presence of the rotational stop 307. Even when the system experiences a pressure drop, the refractory insert is held in place, as-inserted, and will not be forced out of position, even if mortar or fiber gaskets are not used.

Figure 15:
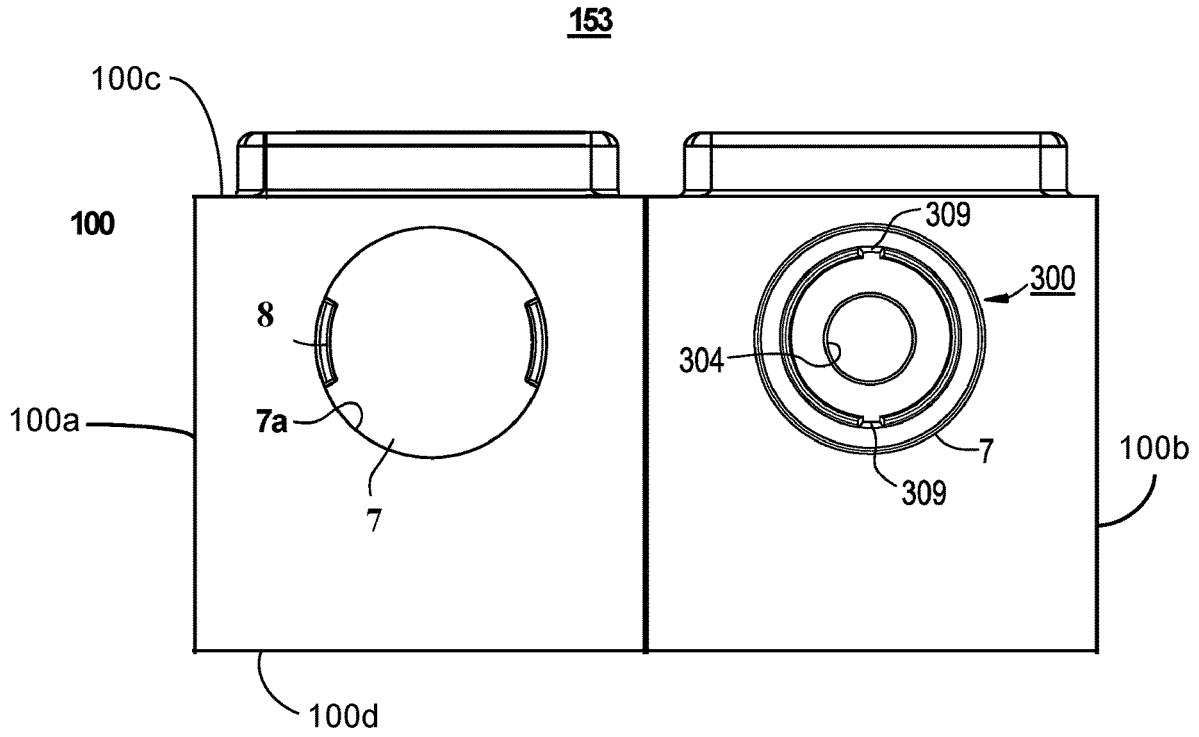
FIG. 15 is a planar view from the downstream side face of an assembly according to the present invention, including a hollow refractory block.
Figure 17:
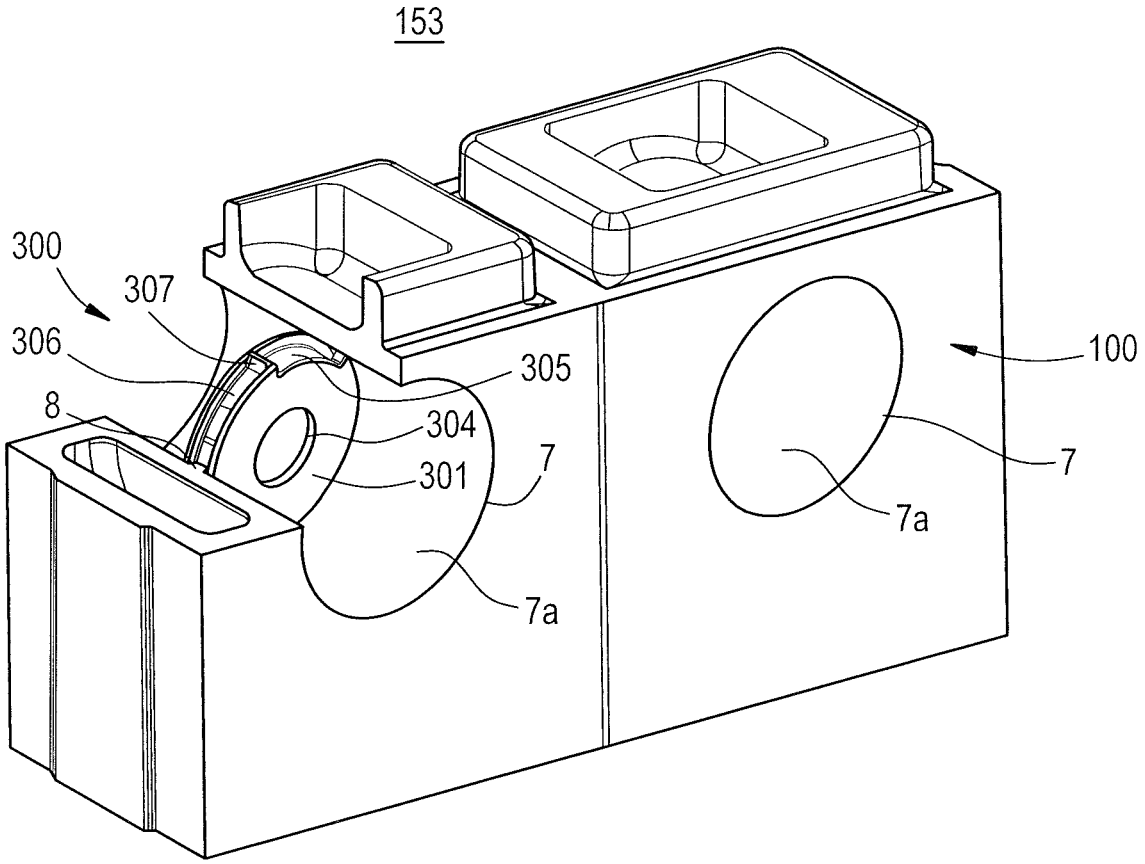
FIG. 17 is a perspective partial cut-view from the upstream side of the assembly shown in FIGS. 15 and 16.

FIG. 15 is a planar view from the downstream side face of a refractory assembly 153 according to the present invention, including a refractory insert 300 and a hollow refractory block 100, FIG. 16 is a perspective partial cut-away view from the downstream side of the assembly 153 shown in FIG. 15, and FIG. 17 is a perspective partial cut-view from the upstream side of the assembly 153 shown in FIGS. 15 and 16. FIG. 18 is a perspective partial cut-view from the downstream side of a refractory assembly 105 according to the present invention, including a conventional refractory brick (block) 200 and a refractory insert 300, and FIG. 19 is a perspective partial cut-away view from the upstream side of the assembly 105 shown in FIG. 18. As shown, the installed refractory inserts 300 are held in place by the tabs 8, 81 of the blocks 100, 200 within the channels 306. The refractory assemblies 105, 153 along with other various refractory structural components and assemblies, can be used to form tunnel assemblies, as described below.

Suitable materials for the refractory inserts, as well as refractory bricks (blocks), refractory bases, and refractory covers (lids), include, but are not limited to alumina-based refractory materials, cordierite (magnesium aluminum silicate), and zirconia, for example. More preferably, the refractory inserts, blocks, lids and bases are made from a material selected from the group consisting of medium duty fire clay brick (Oxide Bonded Alumina comprised of at least 30% alumina by weight), high duty fire clay brick (Oxide Bonded Alumina comprised of at least 35% alumina by weight), super duty fire clay brick (Oxide Bonded Alumina comprised of at least 40% alumina by weight), and high alumina fire clay brick (Oxide Bonded Alumina comprised of at least 60% alumina by weight). Most preferably, the present invention utilizes Mullite Bonded Alumina comprised of 88% alumina by weight or an Oxide Bonded Alumina comprised of 95% alumina by weight.

Figure 6:
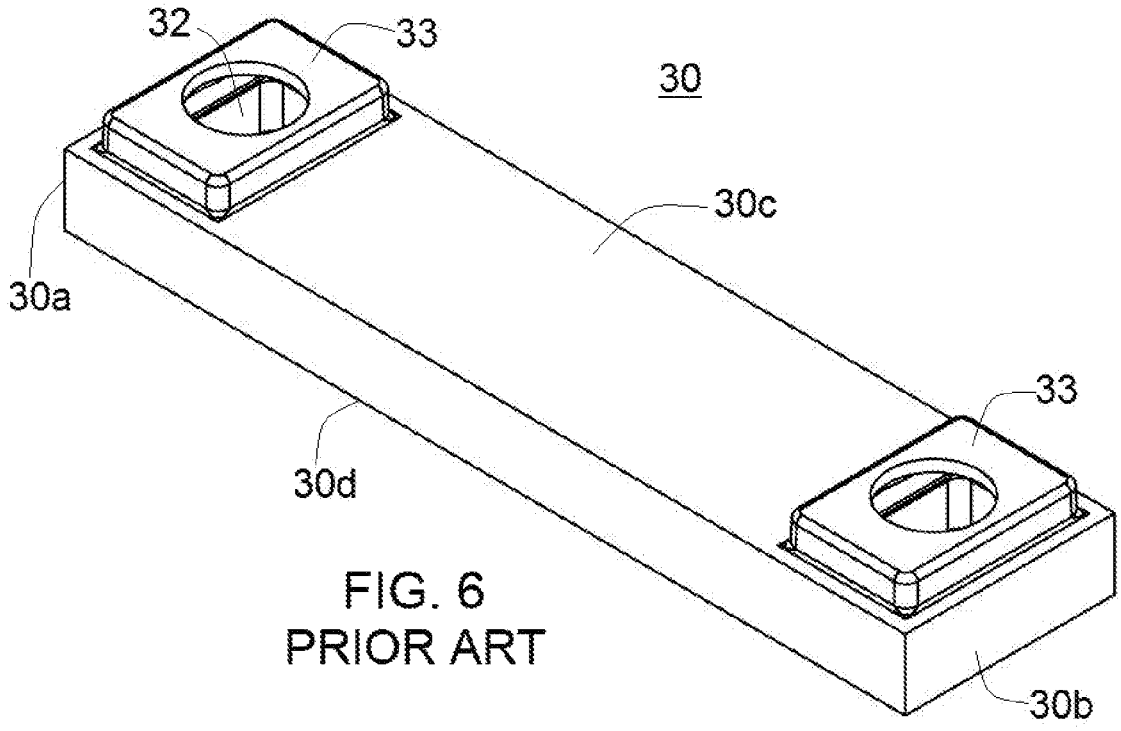
FIG. 6 PRIOR ART
FIG. 6 is a perspective top view of a full width hollow base component.

A tunnel assembly is provided by combining refractory blocks, refractory inserts and other structural members, such as base members and lids. Any type of block, base and lid can be used in connection with the tunnel assembly including refractory inserts having the retention mechanism according to the present invention. An example of a preferred base component 30 used to form a tunnel assembly is shown in FIG. 6. A plurality of base components 30 run the length of the tunnel and span the horizontal width 'w' of the tunnel to connect the two walls together using the same mating features as the wall blocks 10, 100 described above (see, e.g., FIGS. 20-21).

Each base component 30 has an outer peripheral surface with an upper surface 30*c* and an opposed lower (bottom) surface 30*d* on which the interlocking mechanical mating features protruding portions 33, and corresponding openings 34 (not shown) are respectively formed. The protruding portions 33 correspond to the protruding portions 3 described above in connection with the bocks 1, 10, 100, and the openings 34 correspond to the openings 4 described above in connection with the blocks 1, 10, 100. The same critical dimensional requirements for the mechanical mating members and wall thicknesses discussed above apply to the base components, as well. Preferably, each base component 30 has a total weight in a range of about 60-100 lbs., more preferably less than about 70 lbs.

The protruding portions 33 are provided on the upper surface 30*a* of the base components 30 proximate the two opposed ends 30*a*, 30*b*, so as to correspond to the laterally (horizontally) opposed locations of the tunnel walls to be built thereon. The openings 34 are provided in the bottom surface 30*d* of the base component 30 in corresponding locations. In some embodiments, the base component 30 has a plurality of cavities from which unnecessary material has been removed to reduce the weight of the base block. The openings 32 are material removed portions and may or may not communicate with such cavities, and a plurality of additional cavities are provided along the length of the base component 30, separated by interior block walls having sufficient thickness to provide enough material to ensure the structural integrity of the component is maintained. The wall thickness is preferably in a range of 0.5 to 1.5 in, preferably 0.625 to 0.875 in.

As noted above, it is important that the size and material of the base component 30 is substantially the same as that of the lid (discussed in more detail below) in order to properly and effectively compensate for thermal and stress factors, although the base is a heavier component, as one skilled in the art can appreciate. Conventional base and lid members can also be used in connection with the blocks including the refractory inserts according to the present invention to form a tunnel assembly/system.

Figure 7:
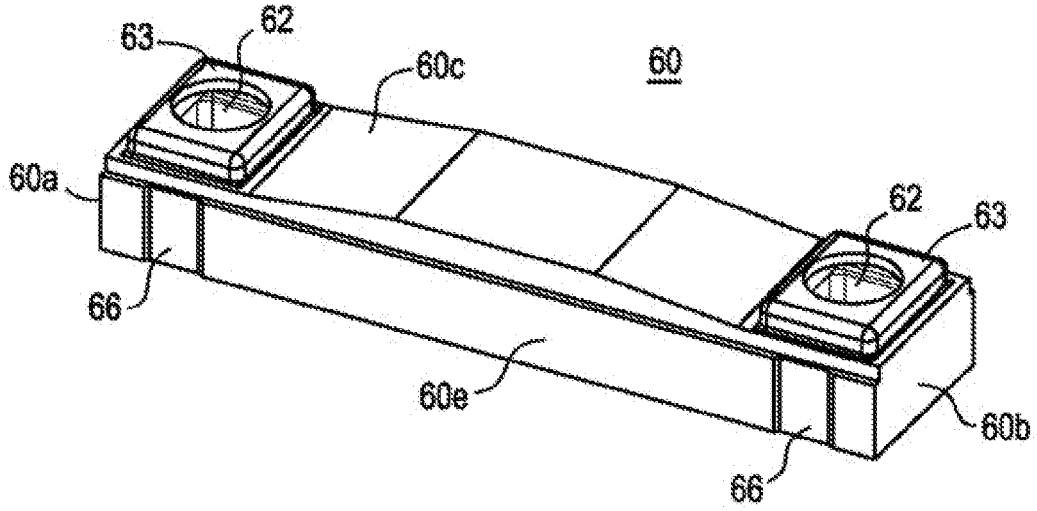
FIG. 7 PRIOR ART
FIG. 7 is a perspective top view of a hollow lid component.

FIG. 7 shows an example of a preferred lid 60. As shown in FIG. 7, the upper surface 60*c* of lid 60 has a flat top with angled sides. The upper surface 60*c* of the lid also includes the same interlocking mechanical mating features 63, 64 as described above in connection with the blocks 1, 10, 100 and the base components 30. In the case of the lid 60, the protruded portions 63 serve two functions. First, the protruding portions 63 provide mechanical mating features in connection with the corresponding openings 4 on other wall blocks 10, 100 in the same manner discussed above, which enable the lid 60 to be used in an assembly where the lid 60 is not the only topmost component, but where additional tunnel wall blocks 10, 100 are instead placed on top of the lid 60, and the walls are continued vertically upward, providing a stacked-lid arrangement (not shown). Second, since the protruding portions 63 extend a distance of at least 0.5 in above (in the vertical direction) the overall surface geometry of the lid 60, this allows for the placement of a plywood board on top of the lid 60 to define a walkway during furnace turnarounds. Because this lid exists directly above the tunnel walls, the walkway allows workers access into the furnace on top of the tunnels without putting weight onto the center of the unsupported span of the lids, and instead directs all of their weight onto the tunnel walls, where it can be readily supported. The span of the top lid 60 can be as small as 12 in, or as wide as 60 in, although the preferred size is a range of 24 in to 36 in.

Figure 8:
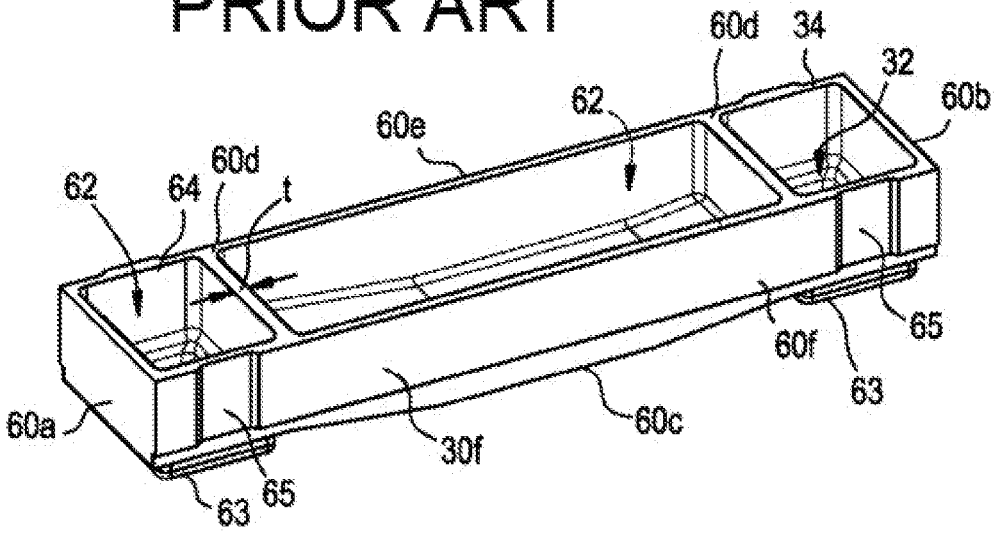
FIG. 8 PRIOR ART
FIG. 8 is a perspective bottom view of the lid shown in FIG. 7.

The lid 60 is also hollowed out from the bottom surface 60*d* to remove all possible material from non-critical areas, in order to minimize the stress by improving the ratio of force per unit area of the cross section. As shown in FIG. 8, a large central cavity 62 is formed thereby, as well as two smaller cavities 62 in communication with the openings 64 defining the mechanical mating features. Preferably, each lid component has a total weight in a range of 50-100 lbs., more preferably in a range of 60-80 lbs. The mechanical mating feature (opening) 64 provides engagement with the protruded portions 3 of the blocks 10, 100 forming the walls 8 to securely attach the lid 60 to the walls 8 on either side, spanning the internal tunnel width between wall structure. The critical dimensions of the mechanical mating features are the same as discussed above. Preferably, the wall thickness "t" of the lids is in a range of 0.5 to 1.5 in, more preferably 0.625 to 0.875 in.

The lids 60 also have additional mechanical mating features such as the grooves 65 formed on side surface 30*f* (see FIG. 8) and protrusion or tab 66 formed on side surface 60*e* (see FIG. 7). These features serve the same purpose and function as the mechanical mating features/expansion gap features 5 and 6 described above in connection with the blocks 1, 10, 100 described above in connection with the base component 30. The position of these mating/expansion features 65, 66 corresponds to the mating alignment with the other lids 60 and the wall blocks 10, 100 stacked thereunder, as described below in more detail in connection with FIGS. 20-21.

Figure 21:
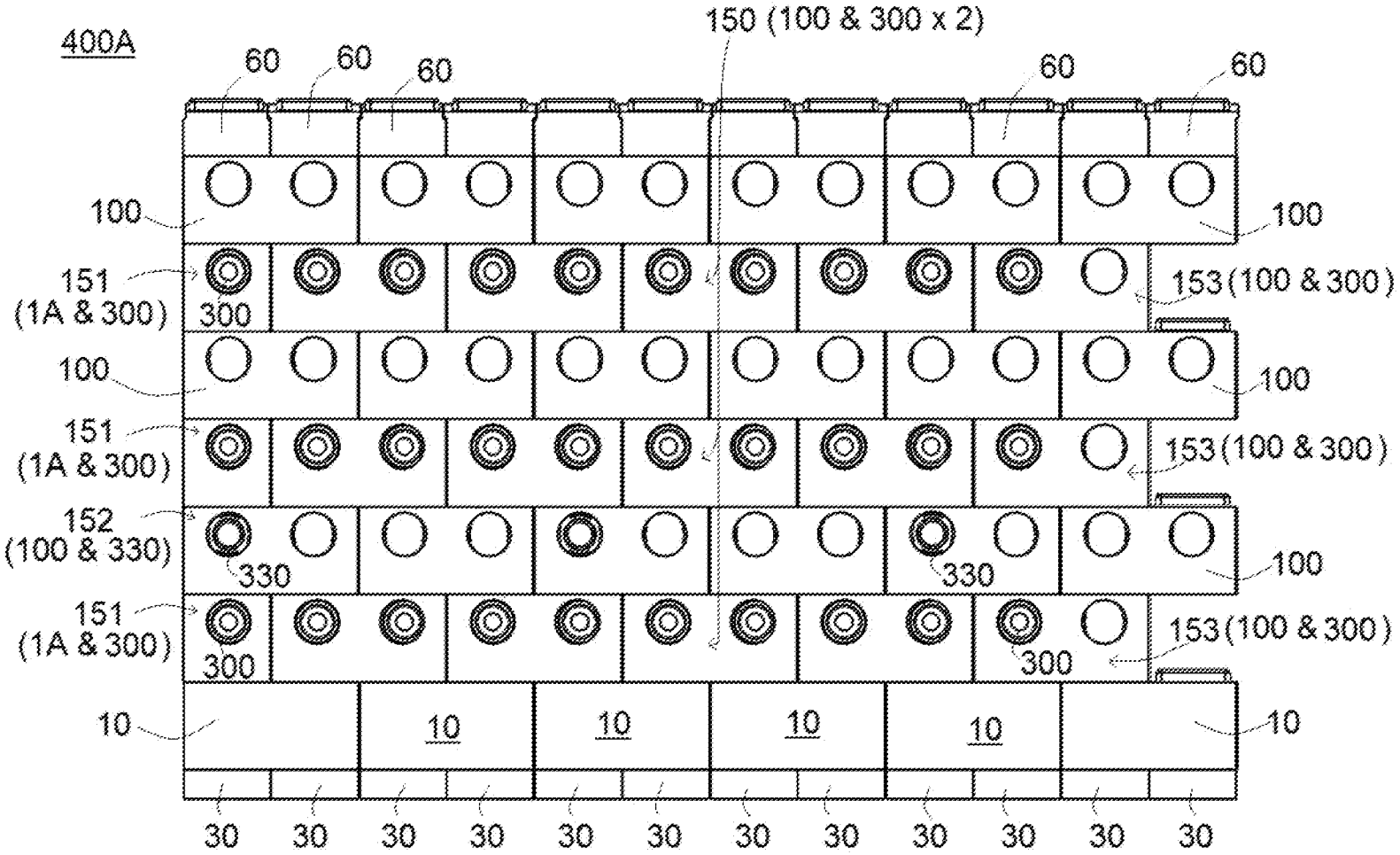
FIG. 21 is a side view of the tunnel assembly shown in FIG. 20 and including refractory inserts.

As shown in FIGS. 20-21, the tunnel assembly 400, 400A includes a plurality of base components 30 are arranged to extend horizontally (in a first direction or the horizontal arrangement direction, i.e., defining a width of the tunnel) and are aligned with respect to one another to define a substantially continuous base surface along the longitudinal extension direction (length) of the tunnel. The base components 30 are secured to one another via the mechanical mating members 35, 36 (preferably without any mortar). A plurality of wall-forming blocks 10 are vertically stacked onto the base components 30 on both opposed sides, along the longitudinal extension direction of the tunnel, which helps further secure the base components 30 in place. The blocks 10 are arranged in a sequentially off-set manner, by one half of a length on the base components 30, using the respective mechanical mating members 33 (protruding portions from the base components 30) and 4 (openings on the blocks 10) to securely fasten the blocks 10 into place on the base components 30 without the use of mortar. The blocks 10 are also secured to one another via the respective mechanical mating members 5, 6. A plurality of blocks 1A, 100 are then stacked vertically and along the longitudinal extension direction on the row of blocks 10 in a similar, half-block off-set manner.

Additional blocks 1A, 100 are then alternately stacked onto one another, secured to one another vertically and horizontally, preferably without mortar, via the respective mechanical mating members 3, 4, 5 and 6, continuing in a half-block, off-set manner, to define two parallel, vertically oriented tunnel walls 8 that extend both in the second (i.e., vertical arrangement direction) from the base components 30 and in the longitudinal extension direction of the tunnel. As shown, some of the blocks correspond to the blocks 10 shown in FIG. 11 (without through-holes 7), and some of the blocks correspond to the blocks 100 shown in FIG. 16, which include through-holes 7. Blocks 1A are otherwise the same as those shown and described as blocks 1 in FIG. 10, with the exception of the though-hole that is included in blocks 1A. It should also be noted that the tunnel structure could be formed using traditional, standard blocks as modified to contain an appropriate through-hole with mating tabs (see, e.g., FIGS. 18-19).

The tunnel walls 8 are spaced a predetermined distance (i.e., 12-60 in, preferably 24 to 36 in) apart from one another in the horizontal arrangement direction, dictated by the horizontal span of the base components 30. Tie bars 50 are inserted into refractory insert using tie bar cradles 15 in desired locations, as needed. Refractory inserts can also be inserted into the through-holes 7 of the blocks 100 in the any location that is desired to define refractory block assemblies at those points (see, e.g., FIG. 21). The tunnel assembly is secured by placing a plurality of lids 60 across the tops of the tunnel walls 8, which are secured in place onto the uppermost blocks 10 via the mechanical mating features (e.g., openings 64 in the lids and the protruding portions 3 of the wall blocks 10), and further secured to one another via the mechanical mating members 65, 66 in the lids 60 to construct the tunnel (also referred to as a tunnel assembly 400 or 400A, see, e.g., FIGS. 20-21).

As discussed above, in the tunnel 400/400A according to the present invention, reducing the weight of all of the components, while maintaining the structural integrity of each of the individual components, makes it possible to eliminate much of the crushing force on the lower courses of the brick (i.e., the base components 30). Providing lightweight, structurally correct cover (lid) components 60 overcomes the drawbacks previously associated with making conventional lids thicker in order to be stronger, which also detrimentally added additional load to the entire system. The incorporation of controlled expansion gaps between each brick and elimination of mortar from the overall system ensures that the tunnel assembly 400/400A can expand and contract without creating large cumulative stresses, and reduces the installation time of the tunnel assembly 400/400A as a whole.

With the reduced wall thickness and improved materials used for the components, the light-weight tunnel lids 60 can be easily installed or removed simply by two laborers. In addition, the light-weight, mortar-free blocks with interlocking mechanical mating features are easily handled by a single laborer, and the tunnel structure 400/400A can assembled, repaired and/or disassembled as necessary without significant consequences or the requirement for high levels of skill. Cross beam supports (i.e., tie bars 50 in respective cradle inserts 15), as well as other refractory inserts, can be easily added or removed from the blocks (block assemblies) in the tunnel assembly 400 without limiting access to other tunnel components during turnarounds, ensuring that repairs can be complete and effective.

The refractory inserts 300, 330 are held in place without the use of mortar by virtue of the retention mechanism according to the present invention, and the loss of refractory inserts during pressure drops is effectively prevented. Faster installation and repair time also allows for proper repairs to be made more readily, improving the overall reliability of the system.

FIGS. 20-21 best illustrate an example of a tunnel 400, 400A including a combination of different blocks 1A (i.e., block 1 with a through-hole), 10 and 100 and different refractory inserts 300, 300 to define a number of different refractory assemblies (e.g., 150, 151, 152 and 153). Refractory assembly (also referred to as a refractory block assembly) 150 includes a block 100 and two refractory inserts 300, refractory assembly 151 includes a block 1A and refractory insert 300, refractory assembly 152 includes a block 100 and refractory insert 330, and refractory assembly 153 includes a block 100 and refractory insert 300. As shown, the refractory inserts 330 are the same as refractory inserts 300 in all respects except for the size of the central opening 304, which is larger in refractory insert 330. Although this embodiment does not depict the use of standard bricks 200, any of the refractory inserts according to the present invention can be used in conjunction with any through-hole location in any type of block of a tunnel system/assembly to define a refractory block assembly within the tunnel assembly, thereby providing a modular system that allows for a universal refractory insert-mating tab to be provided on the surface of the openings of the blocks that are be used in conjunction with any insert in any location in the tunnel. This vast flexibility enables the end user to modify the installation of refractory inserts in any manner that they deem necessary depending on the particular processing conditions and requirements that they face. The improved stability and retention in place reduces the need for replacement upon loss.

While the present invention has been shown and described above with reference to specific examples, it should be understood by those skilled in the art that the present invention is in no way limited to these examples, and that variations and modifications can readily be made thereto without departing from the scope and spirit of the present invention.

What is claimed is:

1. A refractory insert comprising:

a main body part having a first surface defining a first sidewall, an opposed second surface defining a second sidewall, and an outer peripheral surface separating the first surface and the second surface; and a mechanical mating member provided on at least a portion of the outer peripheral surface thereof, the mechanical mating member comprising a retention mechanism for controlling and retaining a position of a corresponding mating member in connection therewith, wherein the retention mechanism of the mechanical mating member comprises at least two diametrically opposed channels in the outer peripheral surface of the refractory insert, each channel being circumferentially defined by the first sidewall and the second sidewall, and wherein the retention mechanism comprises a retention projection member that projects into each channel axially inward from one of the first sidewall and the second sidewall proximate a first end of each channel, and a rotational stop member defining an opposed second end of each channel.

2. The refractory insert according to claim 1, wherein the retention projection member projects into each channel axially inward from one of the sidewalls of the refractory insert facing upstream.

3. The refractory insert according to claim 1, wherein the mechanical mating member comprises at least two diametrically opposed slots, formed in the surfaces of at least one of the first and second sidewalls, and open to the respective channels at least at respective first ends of the respective channels.

4. The refractory insert according to claim 1, wherein the refractory insert further comprises installation notches, formed on portions of at least one of the sidewalls facing downstream and extending diametrically inward toward the opposed sidewall.

5. The refractory insert according to claim 1, wherein the refractory insert is a gas flow changing plug.

6. The refractory insert according to claim 1, wherein the refractory insert further comprises a central opening formed in one of the sidewalls facing upstream.

7. A refractory block assembly comprising:

a refractory block having at least one opening formed therein; and at least one refractory insert that resides within the at least one opening in the refractory block;

wherein the at least one refractory insert comprises a main body part having a first surface defining a first sidewall, an opposed second surface defining a second sidewall, and an outer peripheral surface separating the first and second surfaces, and a mechanical mating member provided on at least a portion of the outer peripheral surface thereof, the mechanical mating member comprising a retention mechanism for controlling and retaining a position of a corresponding mating member provided on an inner surface of the at least one opening in the refractory block, wherein the retention mechanism of the mechanical mating member of the refractory insert comprises at least two diametrically opposed channels in the outer peripheral surface of the refractory insert, the channels being circumferentially defined by the first sidewall and the second sidewall.

8. The refractory block assembly according to claim 7, wherein the retention mechanism of the refractory insert comprises a retention projection member that projects into each channel axially inward from one of the first and second sidewalls proximate a first end of each channel, and a rotational stop member defining an opposed second end of each channel.

9. The refractory block assembly according to claim 7, wherein the at least one refractory insert is a gas flow changing plug.

10. A refractory block assembly for a steam reformer furnace tunnel, the refractory block assembly comprising:

a refractory block comprising a hollow main body portion having outer peripheral surfaces defining a first end, an opposed second end, an upper surface, an opposed lower surface, a first side and an opposed second side, at least one through-hole having openings formed in the first side and the opposed second side of the main body portion, at least one first mechanical mating portion defining a protruded portion extending from a portion of the upper surface of the main body portion, and at least one second corresponding mechanical mating portion defining an opening corresponding to the protruded portion formed in a portion of the lower surface the main body portion; and at least one refractory insert that resides within at least one of the at least one though-hole, the refractory insert comprising a main body part having a first surface defining a first sidewall, an opposed second surface defining a second sidewall, and an outer peripheral surface separating the first and second surfaces, and a mechanical mating member provided on at least a portion of the outer peripheral surface thereof, the mechanical mating member comprising a retention mechanism for controlling and retaining a position of a corresponding mating member provided on an inner surface of the at least one through-hole of the refractory block.

11. The refractory block assembly according to claim 10, wherein the retention mechanism of the mechanical mating member of the refractory insert comprises at least two diametrically opposed channels in the outer peripheral surface of the refractory insert, the channels being circumferentially defined by the first and second sidewalls.

12. The refractory block assembly according to claim 11, wherein the retention mechanism of the mechanical mating member of the refractory insert comprises a retention projection member that projects into each channel axially inward from one of the first and second sidewalls proximate a first end of each channel, and a rotational stop member defining an opposed second end of each channel.

13. A refractory tunnel assembly for a steam reformer furnace, the refractory tunnel assembly comprising:

a plurality of refractory base components;

a plurality of refractory wall blocks, wherein at least a portion of the plurality of refractory wall blocks comprise at least one through-hole having openings formed in opposed side surfaces thereof;

a plurality of refractory lid components; and a refractory insert residing within one or more of the though-holes in the refractory wall blocks, the refractory insert having a main body part having a first surface defining a first sidewall, an opposed second surface defining a second sidewall, and an outer peripheral surface separating the first and second surfaces, and a mechanical mating member provided on at least a portion of the outer peripheral surface thereof, the mechanical mating member comprising a retention mechanism for controlling and retaining a position of a corresponding mating member provided on an inner surface of the at least one through-hole of the refractory wall blocks;

wherein the refractory base components are arranged to extend in a horizontal arrangement direction defining a width of the refractory tunnel assembly and a longitudinal arrangement direction defining a length of the refractory tunnel assembly;

wherein the refractory wall blocks are stacked upon the refractory base components in a vertical arrangement direction and along the longitudinal arrangement direction, and are stacked upon one another in both the vertical and longitudinal arrangement directions, to define two parallel tunnel walls, spaced a distance apart from one another in the horizontal arrangement direction, wherein the two parallel tunnel walls extend upwardly from the refractory base components in the vertical arrangement direction and along the length of the refractory tunnel assembly on the refractory base components; and wherein the plurality of refractory lid components are stacked upon the refractory wall blocks in the vertical arrangement direction and along the longitudinal arrangement direction, so that the refractory lid components extend along the longitudinal arrangement direction and the horizontal arrangement direction in order to cover the distance between the tunnel walls along at least a portion of the length of the refractory tunnel assembly.

14. The refractory tunnel assembly according to claim 13, wherein the plurality of refractory base components comprise a plurality of hollow refractory base components, each hollow refractory base component comprising a plurality of corresponding mechanical mating members;

wherein the plurality of refractory wall blocks comprise a plurality of hollow refractory wall blocks, each hollow refractory wall block comprising a plurality of corresponding mechanical mating members that further correspond to the mechanical mating members of the hollow refractory base components;

wherein the plurality of refractory lid components comprise a plurality of hollow refractory lid components, each hollow refractory lid component comprising a plurality of mechanical mating members that further correspond to the mechanical mating members of the hollow refractory base components and the hollow refractory wall blocks;

wherein the hollow refractory wall blocks are stacked upon and mechanically interconnected to the hollow refractory base components via the corresponding mechanical mating members in the vertical arrangement direction and along the longitudinal arrangement direction, and are stacked upon one another and mechanically interconnected to one another via the corresponding mechanical mating members, without the use of mortar, in both the vertical and longitudinal arrangement directions, to define the two parallel tunnel walls that are spaced a distance apart from one another in the horizontal arrangement direction and which extend upwardly from the base components in the vertical arrangement direction and along the length of the tunnel assembly on the hollow refractory base components; and wherein the plurality of lid components are stacked upon and mechanically interconnected to the hollow refractory wall blocks via the mechanical mating members, without the use of mortar, in the vertical arrangement direction and along the longitudinal arrangement direction.

15. The refractory tunnel assembly according to claim 13, wherein the refractory base components, the refractory wall blocks, the refractory lid components, and the refractory inserts all comprise the same material.

16. The refractory tunnel assembly according to claim 13, wherein the retention mechanism of the mechanical mating member of the refractory insert comprises at least two diametrically opposed channels in the outer peripheral surface of the refractory insert, the channels being circumferentially defined by the first and second sidewalls, and wherein the retention mechanism comprises a retention projection member that projects into each channel axially inward from one of the first and second sidewalls proximate a first end of each channel, and a rotational stop member defining an opposed second end of each channel.

17. The refractory tunnel assembly according to claim 16, wherein the retention projection member projects into each channel axially inward from one of the first and second sidewalls of the refractory insert facing upstream.

* * * * *